US011286622B2

(12) United States Patent
Sealey et al.

(10) Patent No.: US 11,286,622 B2
(45) Date of Patent: Mar. 29, 2022

(54) TISSUE PRODUCT MADE USING LASER ENGRAVED STRUCTURING BELT

(71) Applicant: STRUCTURED I, LLC, Great Neck, NY (US)

(72) Inventors: James E. Sealey, Belton, SC (US); Byrd Tyler Miller, IV, Easley, SC (US); Phillip MacDonald, Anderson, SC (US); Taras Z. Andrukh, Greenville, SC (US); Justin S. Pence, Williamston, SC (US)

(73) Assignee: STRUCTURED I, LLC, Great Neck, NY (US)

( * ) Notice: Subject to any disclaimer, the term of this patent is extended or adjusted under 35 U.S.C. 154(b) by 0 days.

(21) Appl. No.: 16/810,917

(22) Filed: Mar. 6, 2020

(65) Prior Publication Data

US 2020/0308771 A1 Oct. 1, 2020

Related U.S. Application Data

(62) Division of application No. 15/684,731, filed on Aug. 23, 2017, now Pat. No. 10,619,309.

(51) Int. Cl.

| | |
|---|---|
| ***D21H 27/00*** | (2006.01) |
| ***D21H 21/20*** | (2006.01) |
| ***D21H 27/32*** | (2006.01) |
| ***D21H 27/40*** | (2006.01) |
| ***D21H 21/24*** | (2006.01) |
| ***D21H 17/02*** | (2006.01) |

(Continued)

(52) U.S. Cl.

CPC ..... *D21H 27/005* (2013.01); *D21H 17/02* (2013.01); *D21H 17/35* (2013.01); *D21H 21/18* (2013.01); *D21H 21/20* (2013.01); *D21H 21/22* (2013.01); *D21H 21/24* (2013.01); *D21H 27/002* (2013.01); *D21H 27/32* (2013.01); *D21H 27/40* (2013.01)

(58) Field of Classification Search

CPC .... D21H 27/005; D21H 27/002; D21H 21/22; D21H 21/18; D21H 21/24; D21H 21/20; D21H 17/35; D21H 17/02; D21H 27/32; D21H 27/40

See application file for complete search history.

(56) References Cited

U.S. PATENT DOCUMENTS

| | | | |
|---|---|---|---|
| 2,919,467 | A | 1/1960 | Mercer |
| 2,926,154 | A | 2/1960 | Keim |

(Continued)

FOREIGN PATENT DOCUMENTS

| | | | |
|---|---|---|---|
| CA | 2168894 | A1 | 8/1997 |
| CA | 2795139 | A1 | 10/2011 |

(Continued)

OTHER PUBLICATIONS

International Application No. PCT/US2018/47463; International Search Report and Written Opinion dated Oct. 29, 2018.

(Continued)

*Primary Examiner* — Eric Hug

(74) *Attorney, Agent, or Firm* — Amster, Rothstein & Ebenstein LLP

(57) ABSTRACT

A tissue product including a laminate of at least two plies of a multi-layer tissue web, the tissue product having a softness value (HF) of 92.0 or greater, a lint value of 4.5 or less, and an Sdr of greater than 3.0.

20 Claims, 21 Drawing Sheets

(51) Int. Cl.

| | |
|---|---|
| ***D21H 17/35*** | (2006.01) |
| ***D21H 21/22*** | (2006.01) |
| ***D21H 21/18*** | (2006.01) |

(56) References Cited

U.S. PATENT DOCUMENTS

| | | | |
|---|---|---|---|
| 3,026,231 | A | 3/1962 | Chavannes |
| 3,049,469 | A | 8/1962 | Davison |
| 3,058,873 | A | 10/1962 | Keim et al. |
| 3,066,066 | A | 11/1962 | Keim et al. |
| 3,097,994 | A | 7/1963 | Dickens et al. |
| 3,125,552 | A | 3/1964 | Loshaek et al. |
| 3,143,150 | A | 8/1964 | Buchanan |
| 3,186,900 | A | 6/1965 | De Young |
| 3,197,427 | A | 7/1965 | Schmalz |
| 3,224,986 | A | 12/1965 | Butler et al. |
| 3,224,990 | A | 12/1965 | Babcock |
| 3,227,615 | A | 1/1966 | Korden |
| 3,227,671 | A | 1/1966 | Keim |
| 3,239,491 | A | 3/1966 | Tsou et al. |
| 3,240,664 | A | 3/1966 | Earle, Jr. |
| 3,240,761 | A | 3/1966 | Keim et al. |
| 3,248,280 | A | 4/1966 | Hyland, Jr. |
| 3,250,664 | A | 5/1966 | Conte et al. |
| 3,252,181 | A | 5/1966 | Hureau |
| 3,301,746 | A | 1/1967 | Sanford et al. |
| 3,311,594 | A | 3/1967 | Earle, Jr. |
| 3,329,657 | A | 7/1967 | Strazdins et al. |
| 3,332,834 | A | 7/1967 | Reynolds, Jr. |
| 3,332,901 | A | 7/1967 | Keim |
| 3,352,833 | A | 11/1967 | Earle, Jr. |
| 3,384,692 | A | 5/1968 | Galt et al. |
| 3,414,459 | A | 12/1968 | Wells |
| 3,442,754 | A | 5/1969 | Espy |
| 3,459,697 | A | 8/1969 | Goldberg et al. |
| 3,473,576 | A | 10/1969 | Amneus |
| 3,483,077 | A | 12/1969 | Aldrich |
| 3,545,165 | A | 12/1970 | Greenwell |
| 3,556,932 | A | 1/1971 | Coscia et al. |
| 3,573,164 | A | 3/1971 | Friedberg et al. |
| 3,609,126 | A | 9/1971 | Asao et al. |
| 3,666,609 | A | 5/1972 | Kalwaites et al. |
| 3,672,949 | A | 6/1972 | Srown |
| 3,672,950 | A | 6/1972 | Murphy et al. |
| 3,773,290 | A | 11/1973 | Mowery |
| 3,778,339 | A | 12/1973 | Williams et al. |
| 3,813,362 | A | 5/1974 | Coscia et al. |
| 3,855,158 | A | 12/1974 | Petrovich et al. |
| 3,877,510 | A | 4/1975 | Tegtmeier et al. |
| 3,905,863 | A | 9/1975 | Ayers |
| 3,911,173 | A | 10/1975 | Sprague, Jr. |
| 3,974,025 | A | 8/1976 | Ayers |
| 3,994,771 | A | 11/1976 | Morgan, Jr. et al. |
| 3,998,690 | A | 12/1976 | Lyness et al. |
| 4,038,008 | A | 7/1977 | Larsen |
| 4,075,382 | A | 2/1978 | Chapman et al. |
| 4,088,528 | A | 5/1978 | Berger et al. |
| 4,098,632 | A | 7/1978 | Sprague, Jr. |
| 4,102,737 | A | 7/1978 | Morton |
| 4,129,528 | A | 12/1978 | Petrovich et al. |
| 4,147,586 | A | 4/1979 | Petrovich et al. |
| 4,184,519 | A | 1/1980 | McDonald et al. |
| 4,190,692 | A | 2/1980 | Larsen |
| 4,191,609 | A | 3/1980 | Trokhan |
| 4,252,761 | A | 2/1981 | Schoggen et al. |
| 4,320,162 | A | 3/1982 | Schulz |
| 4,331,510 | A | 5/1982 | Wells |
| 4,382,987 | A | 5/1983 | Smart |
| 4,440,597 | A | 4/1984 | Wells et al. |
| 4,501,862 | A | 2/1985 | Keim |
| 4,507,351 | A | 3/1985 | Johnson et al. |
| 4,514,345 | A | 4/1985 | Johnson et al. |
| 4,515,657 | A | 5/1985 | Maslanka |
| 4,528,239 | A | 7/1985 | Trokhan |
| 4,529,480 | A | 7/1985 | Trokhan |
| 4,537,657 | A | 8/1985 | Keim |
| 4,545,857 | A | 10/1985 | Wells |
| 4,637,859 | A | 1/1987 | Trokhan |
| 4,678,590 | A | 7/1987 | Nakamura et al. |
| 4,714,736 | A | 12/1987 | Juhl et al. |
| 4,770,920 | A | 9/1988 | Larsonneur |
| 4,780,357 | A | 10/1988 | Akao |
| 4,808,467 | A | 2/1989 | Suskind et al. |
| 4,836,894 | A | 6/1989 | Chance et al. |
| 4,849,054 | A | 7/1989 | Klowak |
| 4,885,202 | A | 12/1989 | Lloyd et al. |
| 4,891,249 | A | 1/1990 | McIntyre |
| 4,909,284 | A | 3/1990 | Kositake |
| 4,949,668 | A | 8/1990 | Heindel et al. |
| 4,949,688 | A | 8/1990 | Bayless |
| 4,983,256 | A | 1/1991 | Combette et al. |
| 4,996,091 | A | 2/1991 | McIntyre |
| 5,059,282 | A | 10/1991 | Ampulski |
| 5,143,776 | A | 9/1992 | Givens |
| 5,149,401 | A | 9/1992 | Langevin et al. |
| 5,152,874 | A | 10/1992 | Keller |
| 5,211,813 | A | 5/1993 | Sawley et al. |
| 5,239,047 | A | 8/1993 | Devore et al. |
| 5,279,098 | A | 1/1994 | Fukuda |
| 5,281,306 | A | 1/1994 | Kakiuchi et al. |
| 5,334,289 | A | 8/1994 | Trokhan et al. |
| 5,347,795 | A | 9/1994 | Fukuda |
| 5,397,435 | A | 3/1995 | Ostendorf et al. |
| 5,399,412 | A | 3/1995 | Sudall et al. |
| 5,405,501 | A | 4/1995 | Phan et al. |
| 5,409,572 | A | 4/1995 | Kershaw et al. |
| 5,429,686 | A | 7/1995 | Chiu et al. |
| 5,439,559 | A | 8/1995 | Crouse |
| 5,447,012 | A | 9/1995 | Kovacs et al. |
| 5,470,436 | A | 11/1995 | Wagle et al. |
| 5,487,313 | A | 1/1996 | Johnson |
| 5,509,913 | A | 4/1996 | Yeo |
| 5,510,002 | A | 4/1996 | Hermans et al. |
| 5,529,665 | A | 6/1996 | Kaun |
| 5,581,906 | A | 12/1996 | Ensign et al. |
| 5,591,147 | A | 1/1997 | Couture-Dorschner et al. |
| 5,607,551 | A | 3/1997 | Farrington, Jr. et al. |
| 5,611,890 | A | 3/1997 | Vinson et al. |
| 5,628,876 | A | 5/1997 | Ayers et al. |
| 5,635,028 | A | 6/1997 | Vinson et al. |
| 5,649,916 | A | 7/1997 | Dipalma et al. |
| 5,671,897 | A | 9/1997 | Ogg et al. |
| 5,672,248 | A | 9/1997 | Wendt et al. |
| 5,679,222 | A | 10/1997 | Rasch et al. |
| 5,685,428 | A | 11/1997 | Herbers et al. |
| 5,728,268 | A | 3/1998 | Weisman et al. |
| 6,551,691 | B1 | 3/1998 | Weisman et al. |
| 5,746,887 | A | 5/1998 | Wendt et al. |
| 5,753,067 | A | 5/1998 | Fukuda et al. |
| 5,772,845 | A | 6/1998 | Farrington, Jr. et al. |
| 5,806,569 | A | 9/1998 | Gulya et al. |
| 5,827,384 | A | 10/1998 | Canfield et al. |
| 5,832,962 | A | 11/1998 | Kaufman et al. |
| 5,846,380 | A | 12/1998 | Van Phan et al. |
| 5,855,738 | A | 1/1999 | Weisman |
| 5,858,554 | A | 1/1999 | Neal et al. |
| 5,865,950 | A | 2/1999 | Vinson et al. |
| 6,865,396 | B2 | 2/1999 | Ogg et al. |
| 5,893,965 | A | 4/1999 | Trokhan et al. |
| 5,913,765 | A | 6/1999 | Burgess et al. |
| 5,942,085 | A | 8/1999 | Neal et al. |
| 5,944,954 | A | 8/1999 | Vinson et al. |
| 5,948,210 | A | 9/1999 | Huston |
| 5,980,691 | A | 11/1999 | Weisman et al. |
| 6,036,139 | A | 3/2000 | Ogg |
| 6,039,838 | A | 3/2000 | Kaufman et al. |
| 6,048,938 | A | 4/2000 | Neal et al. |
| 6,060,149 | A | 5/2000 | Nissing et al. |
| 6,106,670 | A | 8/2000 | Weisman et al. |
| 6,149,769 | A | 11/2000 | Mohammadi et al. |
| 6,162,327 | A | 12/2000 | Batra et al. |
| 6,162,329 | A | 12/2000 | Vinson et al. |
| 6,187,138 | B1 | 2/2001 | Neal et al. |
| 6,200,419 | B1 | 3/2001 | Phan |

(56) References Cited

U.S. PATENT DOCUMENTS 6,203,667 B1 3/2001 Huhtelin
6,207,734 B1 3/2001 Vinson et al.
6,231,723 B1 5/2001 Kanitz et al.
6,287,426 B1 9/2001 Edwards et al.
6,303,233 B1 10/2001 Amon et al.
6,319,362 B1 11/2001 Huhtelin et al.
6,344,111 B1 2/2002 Wilhelm
6,420,013 B1 7/2002 Vinson et al.
6,420,100 B1 7/2002 Trokhan et al.
6,423,184 B2 7/2002 Vahatalo et al.
6,458,246 B1 10/2002 Kanitz et al.
6,464,831 B1 10/2002 Trokhan et al.
6,473,670 B1 10/2002 Huhtelin
6,521,089 B1 2/2003 Griech et al.
6,537,407 B1 3/2003 Law et al.
6,547,928 B2 4/2003 Barnholtz et al.
6,551,453 B2 4/2003 Weisman et al.
6,572,722 B1 6/2003 Pratt
6,579,416 B1 6/2003 Vinson et al.
6,602,454 B2 8/2003 McGuire et al.
6,607,637 B1 8/2003 Vinson et al.
6,610,173 B1 8/2003 Lindsay et al.
6,613,194 B2 9/2003 Kanitz et al.
6,660,362 B1 12/2003 Lindsay et al.
6,673,202 B2 1/2004 Burazin
6,701,637 B2 5/2004 Lindsay et al.
6,755,939 B2 6/2004 Vinson et al.
6,773,647 B2 8/2004 McGuire et al.
6,797,117 B1 9/2004 McKay et al.
6,808,599 B2 10/2004 Burazin
6,821,386 B2 11/2004 Weisman et al.
6,821,391 B2 11/2004 Scherb et al.
6,827,818 B2 12/2004 Farrington, Jr. et al.
6,863,777 B2 3/2005 Kanitz et al.
6,896,767 B2 5/2005 Wilhelm
6,939,443 B2 9/2005 Ryan et al.
6,998,017 B2 2/2006 Lindsay et al.
6,998,024 B2 2/2006 Burazin
7,005,043 B2 2/2006 Toney et al.
7,014,735 B2 3/2006 Kramer et al.
7,105,465 B2 9/2006 Patel et al.
7,155,876 B2 1/2007 VanderTuin et al.
7,157,389 B2 1/2007 Branham et al.
7,182,837 B2 2/2007 Chen et al.
7,194,788 B2 3/2007 Clark et al.
7,235,156 B2 6/2007 Baggot
7,269,929 B2 9/2007 VanderTuin et al.
7,294,230 B2 11/2007 Flugge-Berendes et al.
7,311,853 B2 12/2007 Vinson et al.
7,328,550 B2 2/2008 Floding et al.
7,339,378 B2 3/2008 Han et al.
7,351,307 B2 4/2008 Scherb et al.
7,387,706 B2 6/2008 Herman et al.
7,399,378 B2 7/2008 Edwards et al.
7,419,569 B2 9/2008 Hermans
7,427,434 B2 9/2008 Busam
7,431,801 B2 10/2008 Conn et al.
7,432,309 B2 10/2008 Vinson
7,442,278 B2 10/2008 Murray et al.
7,452,447 B2 11/2008 Duan et al.
7,476,293 B2 1/2009 Herman et al.
7,494,563 B2 2/2009 Edwards et al.
7,510,631 B2 3/2009 Scherb et al.
7,513,975 B2 4/2009 Burma
7,517,433 B2 * 4/2009 Zwick ..... D21H 21/22 162/109
7,563,344 B2 7/2009 Beuther
7,582,187 B2 9/2009 Scherb et al.
7,611,607 B2 11/2009 Mullally et al.
7,622,020 B2 11/2009 Awofeso
7,662,462 B2 2/2010 Noda
7,670,678 B2 3/2010 Phan
7,683,126 B2 3/2010 Neal et al.
7,686,923 B2 3/2010 Scherb et al.
7,687,140 B2 3/2010 Manifold et al.
7,691,230 B2 4/2010 Scherb et al.
7,744,722 B1 6/2010 Tucker et al.
7,744,726 B2 6/2010 Scherb et al.
7,799,382 B2 9/2010 Payne et al.
7,811,418 B2 10/2010 Erelid et al.
7,815,978 B2 10/2010 Davenport et al.
7,823,366 B2 11/2010 Schoeneck
7,842,163 B2 11/2010 Nickel et al.
7,867,361 B2 1/2011 Salaam et al.
7,871,692 B2 1/2011 Morin et al.
7,887,673 B2 2/2011 Andersson et al.
7,905,989 B2 3/2011 Scherb et al.
7,914,866 B2 3/2011 Shannon et al.
7,931,781 B2 4/2011 Scherb et al.
7,951,269 B2 5/2011 Herman
7,955,549 B2 6/2011 Noda
7,959,764 B2 6/2011 Ringer et al.
7,972,475 B2 7/2011 Chan et al.
7,989,058 B2 8/2011 Manitoldetal
8,034,463 B2 10/2011 Leimbach et al.
8,051,629 B2 11/2011 Pazdemik et al.
8,075,739 B2 12/2011 Scherb et al.
8,092,652 B2 1/2012 Scherb et al.
8,118,979 B2 2/2012 Herman et al.
8,147,649 B1 4/2012 Tucker et al.
8,152,959 B2 4/2012 Elony et al.
8,196,314 B2 6/2012 Munch
8,216,427 B2 7/2012 Klerelid et al.
8,236,135 B2 * 8/2012 Prodoehl ..... B32B 5/26 162/125
8,303,773 B2 11/2012 Scherb et al.
8,382,956 B2 2/2013 Boechat et al.
8,402,673 B2 3/2013 Da Silva et al.
8,409,404 B2 4/2013 Harper et al.
8,435,384 B2 5/2013 Da Silva et al.
8,440,055 B2 5/2013 Scherb et al.
8,445,032 B2 5/2013 Topolkaraev et al.
8,454,800 B2 6/2013 Mourad et al.
8,470,133 B2 6/2013 Cunnane et al.
8,506,756 B2 8/2013 Denis et al.
8,544,184 B2 10/2013 Da Silva et al.
8,574,211 B2 11/2013 Morita
8,580,083 B2 11/2013 Boechat et al.
8,728,277 B2 5/2014 Boechat et al.
8,758,569 B2 6/2014 Aberg et al.
8,771,466 B2 7/2014 Denis et al.
8,801,903 B2 8/2014 Mourad et al.
8,815,057 B2 8/2014 Eberhardt et al.
8,822,009 B2 9/2014 Riviere et al.
8,968,517 B2 3/2015 Ramaratnam et al.
8,980,062 B2 3/2015 Karlsson et al.
9,005,710 B2 4/2015 Jones et al.
D734,617 S 7/2015 Seitzinger et al.
9,095,477 B2 8/2015 Yamaguchi
D738,633 S 9/2015 Seitzinger et al.
9,382,666 B2 7/2016 Ramaratnam et al.
9,506,203 B2 11/2016 Ramaratnam et al.
9,580,872 B2 2/2017 Ramaratnam et al.
9,702,089 B2 7/2017 Ramaratnam et al.
9,702,090 B2 7/2017 Ramaratnam et al.
9,719,213 B2 8/2017 Miller, IV et al.
9,725,853 B2 8/2017 Ramaratnam et al.
2001/0018068 A1 8/2001 Lorenzi et al.
2002/0028230 A1 3/2002 Eichhorn et al.
2002/0060049 A1 5/2002 Kanitz et al.
2002/0061386 A1 5/2002 Carson et al.
2002/0098317 A1 7/2002 Jaschinski et al.
2002/0110655 A1 8/2002 Seth
2002/0115194 A1 8/2002 Lange et al.
2002/0125606 A1 9/2002 McGuire et al.
2003/0024674 A1 2/2003 Kanitz et al.
2003/0056911 A1 3/2003 Hermans et al.
2003/0056917 A1 3/2003 Jimenez
2003/0070781 A1 4/2003 Hermans et al.
2003/0114071 A1 6/2003 Everhart et al.
2003/0159401 A1 8/2003 Sorensson et al.
2003/0188843 A1 10/2003 Kanitz et al.
2003/0218274 A1 11/2003 Boutilier et al.
2004/0118531 A1 6/2004 Shannon et al.

(56) References Cited

U.S. PATENT DOCUMENTS

| | | | |
|---|---|---|---|
| 2004/0123963 | A1 | 7/2004 | Chen |
| 2004/0126601 | A1 | 7/2004 | Kramer et al. |
| 2004/0126710 | A1 | 7/2004 | Hill et al. |
| 2004/0168784 | A1 | 9/2004 | Duan et al. |
| 2004/0173333 | A1 | 9/2004 | Hermans et al. |
| 2004/0234804 | A1 | 11/2004 | Liu et al. |
| 2005/0016704 | A1 | 1/2005 | Huhtelin |
| 2005/0069679 | A1 | 3/2005 | Stelljes et al. |
| 2005/0069680 | A1 | 3/2005 | Stelljes et al. |
| 2005/0098281 | A1 | 5/2005 | Schulz et al. |
| 2005/0112115 | A1 | 5/2005 | Khan |
| 2005/0123726 | A1 | 6/2005 | Broering et al. |
| 2005/0130536 | A1 | 6/2005 | Siebers et al. |
| 2005/0136222 | A1 | 6/2005 | Hada et al. |
| 2005/0148257 | A1 | 7/2005 | Hermans et al. |
| 2005/0150626 | A1 | 7/2005 | Kanitz et al. |
| 2005/0166551 | A1 | 8/2005 | Keane et al. |
| 2005/0241786 | A1 | 11/2005 | Edwards et al. |
| 2005/0241788 | A1 | 11/2005 | Baggot et al. |
| 2005/0252626 | A1 | 11/2005 | Chen et al. |
| 2005/0280184 | A1 | 12/2005 | Sayers et al. |
| 2005/0287340 | A1 | 12/2005 | Morelli et al. |
| 2006/0005916 | A1 | 1/2006 | Stelljes et al. |
| 2006/0013998 | A1 | 1/2006 | Stelljes et al. |
| 2006/0019567 | A1 | 1/2006 | Sayers |
| 2006/0083899 | A1 | 4/2006 | Burazin et al. |
| 2006/0093788 | A1 | 5/2006 | Behm et al. |
| 2006/0113049 | A1 | 6/2006 | Knobloch et al. |
| 2006/0130986 | A1 | 6/2006 | Flugge-Berendes |
| 2006/0194022 | A1 | 8/2006 | Boutilier et al. |
| 2006/0269706 | A1 | 11/2006 | Shannon et al. |
| 2007/0020315 | A1 | 1/2007 | Shannon et al. |
| 2007/0131366 | A1 | 6/2007 | Underhill et al. |
| 2007/0137813 | A1 | 6/2007 | Nickel et al. |
| 2007/0137814 | A1 | 6/2007 | Gao |
| 2007/0170610 | A1 | 7/2007 | Payne et al. |
| 2007/0240842 | A1 | 10/2007 | Scherb et al. |
| 2007/0251659 | A1 | 11/2007 | Fernandes et al. |
| 2007/0251660 | A1 | 11/2007 | Walkenhaus et al. |
| 2007/0267157 | A1 | 11/2007 | Kanitz et al. |
| 2007/0272381 | A1 | 11/2007 | Elony et al. |
| 2007/0275866 | A1 | 11/2007 | Dykstra |
| 2007/0298221 | A1 | 12/2007 | Vinson |
| 2008/0035289 | A1 | 2/2008 | Edwards et al. |
| 2008/0076695 | A1 | 3/2008 | Uitenbroek et al. |
| 2008/0156450 | A1 | 7/2008 | Klerelid et al. |
| 2008/0199655 | A1 | 8/2008 | Monnerie et al. |
| 2008/0245498 | A1 | 10/2008 | Ostendorf et al. |
| 2008/0302493 | A1 | 12/2008 | Boatman |
| 2008/0308247 | A1 | 12/2008 | Ringer et al. |
| 2009/0020248 | A1 | 1/2009 | Sumnicht et al. |
| 2009/0056892 | A1 | 3/2009 | Rekoske |
| 2009/0061709 | A1 | 3/2009 | Nakai et al. |
| 2009/0205797 | A1 | 8/2009 | Fernandes et al. |
| 2009/0218056 | A1 | 9/2009 | Manifold et al. |
| 2010/0065234 | A1 | 3/2010 | Klerelid et al. |
| 2010/0119779 | A1 | 5/2010 | Ostendorf et al. |
| 2010/0224338 | A1 | 9/2010 | Harper et al. |
| 2010/0230064 | A1 | 9/2010 | Eagles et al. |
| 2010/0236034 | A1 | 9/2010 | Eagles et al. |
| 2010/0239825 | A1 | 9/2010 | Sheehan et al. |
| 2010/0272965 | A1 | 10/2010 | Schinkoreit et al. |
| 2011/0027545 | A1 | 2/2011 | Harlacher et al. |
| 2011/0180223 | A1 | 7/2011 | Klerelid et al. |
| 2011/0189435 | A1 | 8/2011 | Manifold et al. |
| 2011/0189442 | A1 | 8/2011 | Manifold et al. |
| 2011/0206913 | A1 | 8/2011 | Manifold et al. |
| 2011/0223381 | A1 | 9/2011 | Sauter et al. |
| 2011/0253329 | A1 | 10/2011 | Manifold et al. |
| 2011/0265967 | A1 | 11/2011 | Van Phan |
| 2011/0303379 | A1 | 12/2011 | Boechat et al. |
| 2012/0144611 | A1 | 6/2012 | Baker et al. |
| 2012/0152475 | A1 | 6/2012 | Edwards et al. |
| 2012/0177888 | A1 | 7/2012 | Escafere et al. |
| 2012/0244241 | A1 | 9/2012 | McNeil |
| 2012/0267063 | A1 | 10/2012 | Klerelid et al. |
| 2012/0297560 | A1 | 11/2012 | Zwick et al. |
| 2013/0008135 | A1 | 1/2013 | Moore et al. |
| 2013/0029105 | A1 | 1/2013 | Miller et al. |
| 2013/0029106 | A1 | 1/2013 | Lee et al. |
| 2013/0133851 | A1 | 5/2013 | Boechat et al. |
| 2013/0150817 | A1 | 6/2013 | Kainth et al. |
| 2013/0160960 | A1 | 6/2013 | Hermans et al. |
| 2013/0209749 | A1 | 8/2013 | Myangiro et al. |
| 2013/0248129 | A1 | 9/2013 | Manifold et al. |
| 2013/0327487 | A1 | 12/2013 | Espinosa et al. |
| 2014/0004307 | A1 | 1/2014 | Sheehan |
| 2014/0041820 | A1 | 2/2014 | Ramaratnam et al. |
| 2014/0041822 | A1 | 2/2014 | Boechat et al. |
| 2014/0050890 | A1 | 2/2014 | Zwick et al. |
| 2014/0053994 | A1 | 2/2014 | Manifold et al. |
| 2014/0096924 | A1 | 4/2014 | Rekokske et al. |
| 2014/0182798 | A1 | 7/2014 | Polat et al. |
| 2014/0209264 | A1 | 7/2014 | Tirimacco et al. |
| 2014/0242320 | A1 | 8/2014 | McNeil et al. |
| 2014/0272269 | A1 | 9/2014 | Hansen |
| 2014/0272747 | A1 | 9/2014 | Ciurkot |
| 2014/0284237 | A1 | 9/2014 | Gosset |
| 2014/0360519 | A1 | 12/2014 | George et al. |
| 2015/0059995 | A1 | 3/2015 | Ramaratnam et al. |
| 2015/0102526 | A1 | 4/2015 | Ward et al. |
| 2015/0129145 | A1 | 5/2015 | Chou et al. |
| 2015/0211179 | A1 | 7/2015 | Alias et al. |
| 2015/0241788 | A1 | 8/2015 | Yamaguchi |
| 2015/0330029 | A1 | 11/2015 | Ramaratnam et al. |
| 2016/0060811 | A1 | 3/2016 | Riding et al. |
| 2016/0090692 | A1 | 3/2016 | Eagles et al. |
| 2016/0090693 | A1 | 3/2016 | Eagles et al. |
| 2016/0130762 | A1 | 5/2016 | Ramaratnam et al. |
| 2016/0145810 | A1 | 5/2016 | Miller, IV |
| 2016/0159007 | A1 | 6/2016 | Miller, IV et al. |
| 2016/0160448 | A1 | 6/2016 | Miller, IV |
| 2016/0185041 | A1 | 6/2016 | Topolkaraev et al. |
| 2016/0185050 | A1 | 6/2016 | Topolkaraev et al. |
| 2016/0273168 | A1 | 9/2016 | Ramaratnam et al. |
| 2016/0273169 | A1 | 9/2016 | Ramaratnam et al. |
| 2016/0289897 | A1 | 10/2016 | Ramaratnam et al. |
| 2016/0289898 | A1 | 10/2016 | Ramaratnam et al. |
| 2016/0362843 | A1 | 12/2016 | Hermans |
| 2017/0044717 | A1 | 2/2017 | Quigley |
| 2017/0101741 | A1 | 4/2017 | Sealey et al. |
| 2017/0167082 | A1 | 6/2017 | Ramaratnam et al. |
| 2017/0226698 | A1 | 8/2017 | LeBrun et al. |
| 2017/0233946 | A1 | 8/2017 | Sealey et al. |
| 2017/0253422 | A1 | 9/2017 | Anklam et al. |
| 2017/0268178 | A1 | 9/2017 | Ramaratnam et al. |

FOREIGN PATENT DOCUMENTS

| | | | |
|---|---|---|---|
| CN | 1138356 | A | 12/1996 |
| CN | 1207149 | A | 2/1999 |
| CN | 1244899 | A | 2/2000 |
| CN | 1268559 | A | 10/2000 |
| CN | 1377405 | A | 10/2002 |
| CN | 2728254 | Y | 9/2005 |
| DE | 4242539 | A1 | 8/1993 |
| EP | 0097036 | A2 | 12/1983 |
| EP | 0979895 | A1 | 2/2000 |
| EP | 1911574 | A1 | 1/2007 |
| EP | 1339915 | B1 | 7/2007 |
| EP | 2123826 | A2 | 5/2009 |
| GB | 946093 | A | 1/1964 |
| JP | 2013208298 | A | 10/2013 |
| JP | 2014213138 | A | 11/2014 |
| WO | 96/06223 | A1 | 2/1996 |
| WO | 03082550 | A2 | 10/2003 |
| WO | 2004045834 | A1 | 6/2004 |
| WO | 2007070145 | A1 | 6/2007 |
| WO | 2008019702 | A1 | 2/2008 |
| WO | 2009006709 | A1 | 1/2009 |
| WO | 2009/061079 | A1 | 5/2009 |
| WO | 2009067079 | A1 | 5/2009 |
| WO | 2011028823 | A1 | 3/2011 |
| WO | 2012003360 | A2 | 1/2012 |

(56) References Cited

FOREIGN PATENT DOCUMENTS

| | | | |
|---|---|---|---|
| WO | 2013024297 | A1 | 2/2013 |
| WO | 2013136471 | A1 | 9/2013 |
| WO | 2014/022848 | A1 | 2/2014 |
| WO | 2015000755 | A1 | 5/2015 |
| WO | 2015/176063 | A1 | 11/2015 |
| WO | 2016/077594 | A1 | 5/2016 |
| WO | 2016/086019 | A1 | 6/2016 |
| WO | 2016/090242 | A1 | 6/2016 |
| WO | 2016/090364 | A1 | 6/2016 |
| WO | 2016085704 | A1 | 6/2016 |
| WO | 2017066465 | A1 | 4/2017 |
| WO | 2017066656 | A1 | 4/2017 |
| WO | 2017139786 | A1 | 8/2017 |

OTHER PUBLICATIONS

International Search Report for PCT/US16/56871 dated Jan. 12, 2017.
Written Opinion of International Searching Authority for PCT/US16/56871 dated Jan. 12, 2017.
International Search Report for PCT/US2016/057163 dated Dec. 23, 2016.
Written Opinion of International Searching Authority for PCT/US2016/057163 dated Dec. 23, 2016.
International Search Report for PCT/US2017/029890 dated Jul. 14, 2017.
Written Opinion of International Searching Authority for PCT/US2017/029890 dated Jul. 14, 2017.
International Search Report for PCT/US2017/032746 dated Aug. 7, 2017.
Written Opinion of International Searching Authority for PCT/US2017/032746 dated Aug. 7, 2017.
International Search Report for PCT/US17/17705 dated Jun. 9, 2017.
Written Opinion of International Searching Authority for PCT/US17/17705 dated Jun. 9, 2017.
Written Opinion of International Searching Authority for PCT/US15/62483 dated May 6, 2016.
International Search Report for PCT/US15/63986 dated Mar. 29, 2016.
Written Opinion of International Searching Authority for PCT/US15/63986 dated Mar. 29, 2016.
International Search Report for PCT/US15/64284 dated Feb. 11, 2016.
Written Opinion of International Searching Authority for PCT/US15/64284 dated Feb. 11, 2016.
International Search Report for PCT/US13/53593 dated Dec. 30, 2013.
Written Opinion of International Searching Authority for PCT/US13/53593 dated Dec. 30, 2013.
International Search Report for PCT/US15/31411 dated Aug. 13, 2015.
Written Opinion of International Searching Authority for PCT/US15/31411 dated Aug. 13, 2015.
International Search Report for PCT/US15/60398 dated Jan. 29, 2016.
Written Opinion of International Searching Authority for PCT/US15/60398 dated Jan. 29, 2016.
International Search Report for PCT/US15/62483 dated May 6, 2016.
International Preliminary Report on Patentability of PCT/US2013/053593 dated Feb. 3, 2015.
Supplementary European Search Report of EP 13 82 6461 dated Apr. 1, 2016.

* cited by examiner $$Sdr = \left[\frac{Actual\ Surface\ Area}{Projected\ Area} - 1.0\right] \times 100\%$$

| Brand | Wet Laid Technology | Month | City, State | Store | Basis Wt (g/m^2) | Caliper (microns) |
|---|---|---|---|---|---|---|
| EXAMPLE 1 | NTT | | | | 39.51 | 426 |
| Charmin Essentials Soft | TAD | Oct-16 | Mill Hall, PA | Walmart NE | 33.98 | 507 |
| Charmin Strong West | TAD | Nov-16 | Roseville, CA | Walmart | 36.89 | 563 |
| Charmin Essentials Strong | TAD | Oct-16 | Mill Hall, PA | Walmart NE | 28.05 | 347 |
| Charmin Strong NE | TAD | Oct-16 | Mill Hall, PA | Sam's Club | 37.75 | 480 |
| Great Value Strong | TAD | Aug-16 | Roseville, CA | Walmart West | 41.39 | 491 |
| Kirkland Signature | Conventional | Nov-16 | Roseville, CA | Costco West | 37.2 | 337 |
| Great Value Soft | TAD | Aug-16 | Roseville, CA | Walmart West | 45.82 | 486 |
| Up & Up Ultra Soft | TAD | Aug-16 | Roseville, CA | Target West | 37.56 | 442 |
| Cottonelle Cleancare | UCTAD | Oct-16 | Mill Hall, PA | Walmart NE | 41.03 | 673 |
| Charmin Strong NE | TAD | Oct-16 | Mill Hall, PA | Walmart | 38.05 | 502 |
| Charmin Soft West | TAD | Nov-16 | Roseville, CA | Sam's Club | 46.73 | 569 |
| Charmin Strong West | TAD | Nov-16 | Roseville, CA | Sam's Club | 37.45 | 434 |
| Charmin Soft West | TAD | Nov-16 | Roseville, CA | Walmart | 45.12 | 487 |
| Quilted Northern | ETAD | Nov-16 | Roseville, CA | Sam's Club West | 41.12 | 482 |
| DG Home Premium | NTT | Feb-17 | State College, Pennsylvania | Dollar General | 39.45 | 401 |
| Charmin Soft NE | TAD | Oct-16 | Mill Hall, PA | Sam's Club | 48.65 | 557 |
| White Cloud Ultra Strong & Soft | TAD | Oct-16 | Mill Hall, PA | Walmart NE | 39.67 | 439 |
| Charmin Soft NE | TAD | Oct-16 | Mill Hall, PA | Walmart | 45.79 | 526 |
| White Cloud Ultra Soft & Thick | Conventional | Oct-16 | Mill Hall, PA | Walmart NE | 49.24 | 451 |
| Cottonelle Comfortcare | UCTAD | Nov-16 | Roseville, CA | Target West | 45.24 | 606 |
| Member's Mark Mexico | NTT | Sep-14 | Mexico | Sam's Club | 32.63 | 273 |
| Member's Mark | TAD | Sep-16 | Roseville, CA | Sam's Club West | 39.48 | 475 |
| Level Max Mexico | NTT | Sep-14 | Mexico | Sam's Club | 30.75 | 401 |
| HEB Ultra Soft | TAD | Nov-16 | Antonio, TX | HEB Texas | 43.33 | 411 |
| Angel Soft | Conventional | Nov-16 | Roseville, CA | Walmart west | 37.23 | 474 |
| Quilted Northern Ultra | Conventional and ETAD | Nov-16 | Roseville, CA | Costco West | 53.62 | 606 |

FIG. 17A

| Brand | MD Tensile Strength (N/m) | MD Stretch (%) | CD Tensile Strength (N/m) | CD Stretch (%) | HF | Lint Value | Sdr | Bulk/Sdr |
|---|---|---|---|---|---|---|---|---|
| EXAMPLE 1 | 144.5 | 24.1 | 51.1 | 7.2 | 93.4 | 4.3 | 3.200 | 133 |
| Charmin Essentials Soft | 174.4 | 26.4 | 77.4 | 15.8 | 86.5 | 1.6 | 5.871 | 86 |
| Charmin Strong West | 178.1 | 16.0 | 89.9 | 12.8 | 89.7 | 6.5 | 4.080 | 138 |
| Charmin Essentials Strong | 184.9 | 25.3 | 76.2 | 7.6 | 88.1 | 5.9 | 2.256 | 154 |
| Charmin Strong NE | 168.7 | 14.3 | 72.9 | 12.3 | 89.4 | 4.7 | 3.120 | 154 |
| Great Value Strong | 162.5 | 15.4 | 105.5 | 6.8 | 86.4 | 6.2 | 3.188 | 154 |
| Kirkland Signature | 131.6 | 23.2 | 56.5 | 6.6 | 91.1 | 10.2 | 2.161 | 156 |
| Great Value Soft | 134.4 | 19.4 | 89.0 | 6.7 | 91.1 | 8.0 | 2.854 | 170 |
| Up & Up Ultra Soft | 136.5 | 12.3 | 85.2 | 6.0 | 84.8 | 3.7 | 2.534 | 174 |
| Cottonelle Cleancare | 150.9 | 12.6 | 66.2 | 10.7 | 81.8 | 8.5 | 3.846 | 175 |
| Charmin Strong NE | 182.5 | 15.8 | 94.7 | 15.1 | 89.6 | 5.0 | 2.801 | 179 |
| Charmin Soft West | 125.9 | 24.1 | 63.0 | 12.1 | 95.6 | 9.9 | 3.108 | 183 |
| Charmin Strong West | 196.2 | 16.5 | 100.2 | 9.3 | 89.9 | 5.6 | 2.361 | 184 |
| Charmin Soft West | 130.9 | 22.4 | 67.5 | 13.0 | 97.7 | 15.5 | 2.633 | 185 |
| Quilted Northern | 141.4 | 26.0 | 79.4 | 9.2 | 85.3 | 4.9 | 2.531 | 190 |
| DG Home Premium | 140.0 | 21.0 | 72.5 | 6.5 | 81.8 | 3.1 | 2.104 | 191 |
| Charmin Soft NE | 134.5 | 25.3 | 68.2 | 12.6 | 97.5 | 10.2 | 2.753 | 202 |
| White Cloud Ultra Strong & Soft | 164.5 | 18.2 | 118.8 | 7.3 | 88.2 | 7.9 | 2.083 | 211 |
| Charmin Soft NE | 125.3 | 23.2 | 63.7 | 11.8 | 98.8 | 11.3 | 2.465 | 213 |
| White Cloud Ultra Soft & Thick | 225.5 | 16.8 | 67.6 | 8.3 | 82.0 | 2.6 | 2.066 | 218 |
| Cottonelle Comfortcare | 139.2 | 10.1 | 61.8 | 10.4 | 87.9 | 8.2 | 2.712 | 223 |
| Member's Mark Mexico | 231.5 | 18.1 | 60.6 | 7.2 | 85.4 | 1.1 | 1.174 | 233 |
| Member's Mark | 167.4 | 11.2 | 94.7 | 8.8 | 84.3 | 4.6 | 2.013 | 236 |
| Level Max Mexico | 183.7 | 16.7 | 60.2 | 9.8 | 84.7 | 3.6 | 1.650 | 243 |
| HEB Ultra Soft | 149.5 | 14.0 | 75.7 | 5.5 | 91.5 | 11.8 | 1.622 | 253 |
| Angel Soft | 140.0 | 18.4 | 50.5 | 10.0 | 84.6 | 5.8 | 1.410 | 336 |
| Quilted Northern Ultra | 131.0 | 17.9 | 56.3 | 9.1 | 91.8 | 7.3 | 1.758 | 345 |

FIG. 17B

| Brand | Wet Laid Technology | Month/ Yr | City, State | Store | Basis Wt (g/m^2) | Caliper (microns) |
|---|---|---|---|---|---|---|
| Comparative Example 3 | TAD | Jan-17 | Karlstad, Sweden | N/A | 39.6 | 567 |
| Example 2 | TAD | Jan-17 | Karlstad, Sweden | N/A | 39.87 | 586.16 |
| Chamrin Essentials Soft | TAD | Oct-16 | Mill Hall, PA | Walmart NE | 33.98 | 507 |
| Charmin Strong West | TAD | Nov-16 | Roseville, CA | Walmart | 36.89 | 563 |
| Charmin Essentials Strong | TAD | Oct-16 | Mill Hall, PA | Walmart NE | 28.05 | 347 |
| Charmin Strong NE | TAD | Oct-16 | Mill Hall, PA | Sam's Club | 37.75 | 480 |
| Great Value Strong | TAD | Aug-16 | Roseville, CA | Walmart West | 41.39 | 491 |
| Kirkland Signature | Conventional | Nov-16 | Roseville, CA | Costco West | 37.2 | 337 |
| Great Value Soft | TAD | Aug-16 | Roseville, CA | Walmart West | 45.82 | 486 |
| Up & Up Ultra Soft | TAD | Aug-16 | Roseville, CA | Target West | 37.56 | 442 |
| Cottonelle Cleancare | UCTAD | Oct-16 | Mill Hall, PA | Walmart NE | 41.03 | 673 |
| Charmin Strong NE | TAD | Oct-16 | Mill Hall, PA | Walmart | 38.05 | 502 |
| Charmin Soft West | TAD | Nov-16 | Roseville, CA | Sam's Club | 46.73 | 569 |
| Charmin Strong West | TAD | Nov-16 | Roseville, CA | Sam's Club | 37.45 | 434 |
| Charmin Soft West | TAD | Nov-16 | Roseville, CA | Walmart | 45.12 | 487 |
| Quilted Northern | ETAD | Nov-16 | Roseville, CA | Sam's Club West | 41.12 | 482 |
| DG Home Premium | NTT | Feb-17 | State College, Pennsylvania | Dollar General | 39.45 | 401 |
| Charmin Soft NE | TAD | Oct-16 | Mill Hall, PA | Sam's Club | 48.65 | 557 |
| White Cloud Ultra Strong & Soft | TAD | Oct-16 | Mill Hall, PA | Walmart NE | 39.67 | 439 |
| Charmin Soft NE | TAD | Oct-16 | Mill Hall, PA | Walmart | 45.79 | 526 |
| White Cloud Ultra Soft & Thick | Conventional | Oct-16 | Mill Hall, PA | Walmart NE | 49.24 | 451 |
| Cottonelle Comfortcare | UCTAD | Nov-16 | Roseville, CA | Target West | 45.24 | 606 |
| Member's Mark Mexico | NTT | Sep-14 | Mexico | Sam's Club | 32.63 | 273 |
| Member's Mark | TAD | Sep-16 | Roseville, CA | Sam's Club West | 39.48 | 475 |
| Level Max Mexico | NTT | Sep-14 | Mexico | Sam's Club | 30.75 | 401 |
| HEB Ultra Soft | TAD | Nov-16 | Antonio, TX | HEB Texas | 43.33 | 411 |
| Angel Soft | Conventional | Nov-16 | Roseville, CA | Walmart west | 37.23 | 474 |
| Quilted Northern Ultra | Conventional and ETAD | Nov-16 | Roseville, CA | Costco West | 53.62 | 606 |

FIG. 18A

| Brand | MD Tensile Strength (N/m) | MD Stretch (%) | CD Tensile Strength (N/m) | CD Stretch (%) | CD Wet | GM Tensile | GM Stretch |
|---|---|---|---|---|---|---|---|
| Comparative Example 3 | 128.9 | 15.9 | 70.3 | 7.4 | 10.11 | 95.21 | 10.87 |
| Example 2 | 126.3 | 13.2 | 75.3 | 8.6 | 13.02 | 97.50 | 10.66 |
| Charmin Essentials Soft | 174.4 | 26.4 | 77.4 | 15.8 | 19.84 | 116.18 | 20.41 |
| Charmin Strong West | 178.1 | 16.0 | 89.9 | 12.8 | 19.33 | 126.50 | 14.28 |
| Charmin Essentials Strong | 184.9 | 25.3 | 76.2 | 7.6 | 18.99 | 118.69 | 13.87 |
| Charmin Strong NE | 168.7 | 14.3 | 72.9 | 12.3 | 17.29 | 110.86 | 13.29 |
| Great Value Strong | 162.5 | 15.4 | 105.5 | 6.8 | 12.97 | 130.93 | 10.23 |
| Kirkland Signature | 131.6 | 23.2 | 56.5 | 6.6 | 10.76 | 86.23 | 12.42 |
| Great Value Soft | 134.4 | 19.4 | 89.0 | 6.7 | 17.21 | 109.37 | 11.42 |
| Up & Up Ultra Soft | 136.5 | 12.3 | 85.2 | 6.0 | 11.27 | 107.83 | 8.58 |
| Cottonelle Cleancare | 150.9 | 12.6 | 66.2 | 10.7 | 20.69 | 99.94 | 11.63 |
| Charmin Strong NE | 182.5 | 15.8 | 94.7 | 15.1 | 18.63 | 131.42 | 15.43 |
| Charmin Soft West | 125.9 | 24.1 | 63.0 | 12.1 | 15.29 | 89.05 | 17.04 |
| Charmin Strong West | 196.2 | 16.5 | 100.2 | 9.3 | 19.76 | 140.19 | 12.36 |
| Charmin Soft West | 130.9 | 22.4 | 67.5 | 13.0 | 17.82 | 93.97 | 17.09 |
| Quilted Northern | 141.4 | 26.0 | 79.4 | 9.2 | 16.73 | 105.98 | 15.42 |
| DG Home Premium | 140.0 | 21.0 | 72.5 | 6.5 | N/A | 100.75 | 11.68 |
| Charmin Soft NE | 134.5 | 25.3 | 68.2 | 12.6 | 18.74 | 95.79 | 17.84 |
| White Cloud Ultra Strong & Soft | 164.5 | 18.2 | 118.8 | 7.3 | 16.25 | 139.81 | 11.49 |
| Charmin Soft NE | 125.3 | 23.2 | 63.7 | 11.8 | 18.42 | 89.34 | 16.57 |
| White Cloud Ultra Soft & Thick | 225.5 | 16.8 | 67.6 | 8.3 | 11.68 | 123.47 | 11.84 |
| Cottonelle Comfortcare | 139.2 | 10.1 | 61.8 | 10.4 | 13.06 | 92.70 | 10.22 |
| Member's Mark Mexico | 231.5 | 18.1 | 60.6 | 7.2 | 7.06 | 118.43 | 11.43 |
| Member's Mark | 167.4 | 11.2 | 94.7 | 8.8 | 8.82 | 125.91 | 9.92 |
| Level Max Mexico | 183.7 | 16.7 | 60.2 | 9.8 | 6.86 | 105.13 | 12.77 |
| HEB Ultra Soft | 149.5 | 14.0 | 75.7 | 5.5 | 20.17 | 106.42 | 8.78 |
| Angel Soft | 140.0 | 18.4 | 50.5 | 10.0 | 7.75 | 84.08 | 13.55 |
| Quilted Northern Ultra | 131.0 | 17.9 | 56.3 | 9.1 | 17.35 | 85.90 | 12.74 |

FIG. 18B

| Brand | Ball Burst | HF | Lint Value | Ball Burst/ (GMT * GMS) | Ball Burst/ GMT | Sdr |
|---|---|---|---|---|---|---|
| Comparative Example 3 | 269.08 | 88.1 | 4.4 | 0.26 | 2.83 | 3.180 |
| Example 2 | 318.44 | 84.1 | 1.8 | 0.31 | 3.27 | 3.402 |
| Charmin Essentials Soft | 362.54 | 86.5 | 1.6 | 0.15 | 3.12 | 5.871 |
| Charmin Strong West | 370.03 | 89.7 | 6.5 | 0.20 | 2.93 | 4.080 |
| Charmin Essentials Strong | 228.89 | 88.1 | 5.9 | 0.14 | 1.93 | 2.256 |
| Charmin Strong NE | 312.6 | 89.4 | 4.7 | 0.21 | 2.82 | 3.120 |
| Great Value Strong | 255.18 | 86.4 | 6.2 | 0.19 | 1.95 | 3.188 |
| Kirkland Signature | 123.54 | 91.1 | 10.2 | 0.12 | 1.43 | 2.161 |
| Great Value Soft | 181.98 | 91.1 | 8.0 | 0.15 | 1.66 | 2.854 |
| Up & Up Ultra Soft | 216.15 | 84.8 | 3.7 | 0.23 | 2.00 | 2.534 |
| Cottonelle Cleancare | 244.46 | 81.8 | 8.5 | 0.21 | 2.45 | 3.846 |
| Charmin Strong NE | 348.19 | 89.6 | 5.0 | 0.17 | 2.65 | 2.801 |
| Charmin Soft West | 206.45 | 95.6 | 9.9 | 0.14 | 2.32 | 3.108 |
| Charmin Strong West | 334.64 | 89.9 | 5.6 | 0.19 | 2.39 | 2.361 |
| Charmin Soft West | 252.14 | 97.7 | 15.5 | 0.16 | 2.68 | 2.633 |
| Quilted Northern | 228.49 | 85.3 | 4.9 | 0.14 | 2.16 | 2.531 |
| DG Home Premium | 200 | 81.8 | 3.1 | 0.17 | 1.99 | 2.104 |
| Charmin Soft NE | 248.3 | 97.5 | 10.2 | 0.15 | 2.59 | 2.753 |
| White Cloud Ultra Strong & Soft | 259.22 | 88.2 | 7.9 | 0.16 | 1.85 | 2.083 |
| Charmin Soft NE | 229.7 | 98.8 | 11.3 | 0.16 | 2.57 | 2.465 |
| White Cloud Ultra Soft & Thick | 289.15 | 82.0 | 2.6 | 0.20 | 2.34 | 2.066 |
| Cottonelle Comfortcare | 254.77 | 87.9 | 8.2 | 0.27 | 2.75 | 2.712 |
| Member's Mark Mexico | 254.77 | 85.4 | 1.1 | 0.19 | 2.15 | 1.174 |
| Member's Mark | 292.38 | 84.3 | 4.6 | 0.23 | 2.32 | 2.013 |
| Level Max Mexico | 215.00 | 84.7 | 3.6 | 0.16 | 2.05 | 1.650 |
| HEB Ultra Soft | 182.18 | 91.5 | 11.8 | 0.19 | 1.71 | 1.622 |
| Angel Soft | 195.73 | 84.6 | 5.8 | 0.17 | 2.33 | 1.410 |
| Quilted Northern Ultra | 225.66 | 91.8 | 7.3 | 0.21 | 2.63 | 1.758 |

FIG. 18C

TISSUE PRODUCT MADE USING LASER ENGRAVED STRUCTURING BELT

RELATED APPLICATION

This application is a divisional of U.S. patent application Ser. No. 15/684,731, filed Aug. 23, 2017 and entitled TISSUE PRODUCT MADE USING LASER ENGRAVED STRUCTURING BELT, the contents of which are incorporated herein by reference in their entirety.

FIELD OF THE INVENTION

This disclosure relates to fabrics or belts for a papermaking machine, and in particular to fabrics or belts that include polymeric layers and that are intended for use on papermaking machines for the production of tissue products.

BACKGROUND

Tissue manufacturers that can deliver the highest quality product at the lowest cost have a competitive advantage in the marketplace. A key component in determining the cost and quality of a tissue product is the manufacturing process utilized to create the product. For tissue products, there are several manufacturing processes available including conventional dry crepe, through air drying (TAD), or "hybrid" technologies such as Valmet's NTT and QRT processes, Georgia Pacific's ETAD, and Voith's ATMOS process. Each has differences as to installed capital cost, raw material utilization, energy cost, production rates, and the ability to generate desired attributes such as softness, strength, and absorbency.

Conventional manufacturing processes include a forming section designed to retain the fiber, chemical, and filler recipe while allowing the water to drain from the web. Many types of forming sections, such as inclined suction breast roll, twin wire C-wrap, twin wire S-wrap, suction forming roll, and Crescent formers, include the use of forming fabrics.

Forming fabrics are woven structures that utilize monofilaments (such as yarns or threads) composed of synthetic polymers (usually polyethylene, polypropylene, or nylon). A forming fabric has two surfaces, the sheet side and the machine or wear side. The wear side is in contact with the elements that support and move the fabric and are thus prone to wear. To increase wear resistance and improve drainage, the wear side of the fabric has larger diameter monofilaments compared to the sheet side. The sheet side has finer yarns to promote fiber and filler retention on the fabric surface.

Different weave patterns are utilized to control other properties such as: fabric stability, life potential, drainage, fiber support, and clean-ability. There are three basic types of forming fabrics: single layer, double layer, and triple layer. A single layer fabric is composed of one yarn system made up of cross direction (CD) yarns (also known as shute yarns) and machine direction (MD) yarns (also known as warp yarns). The main issue for single layer fabrics is a lack of dimensional stability. A double layer forming fabric has one layer of warp yarns and two layers of shute yarns. This multilayer fabric is generally more stable and resistant to stretching. Triple layer fabrics have two separate single layer fabrics bound together by separated yarns called binders. Usually the binder fibers are placed in the cross direction but can also be oriented in the machine direction. Triple layer fabrics have further increased dimensional stability, wear potential, drainage, and fiber support than single or double layer fabrics.

The manufacturing of forming fabrics includes the following operations: weaving, initial heat setting, seaming, final heat setting, and finishing. The fabric is made in a loom using two interlacing sets of monofilaments (or threads or yarns). The longitudinal or machine direction threads are called warp threads and the transverse or machine direction threads are called shute threads. After weaving, the forming fabric is heated to relieve internal stresses to enhance dimensional stability of the fabric. The next step in manufacturing is seaming. This step converts the flat woven fabric into an endless forming fabric by joining the two MD ends of the fabric. After seaming, a final heat setting is applied to stabilize and relieve the stresses in the seam area. The final step in the manufacturing process is finishing, whereby the fabric is cut to width and sealed.

There are several parameters and tools used to characterize the properties of the forming fabric: mesh and count, caliper, frames, plane difference, open area, air permeability, void volume and distribution, running attitude, fiber support, drainage index, and stacking. None of these parameters can be used individually to precisely predict the performance of a forming fabric on a paper machine, but together the expected performance and sheet properties can be estimated. Examples of forming fabrics designs can be viewed in U.S. Pat. Nos. 3,143,150, 4,184,519, 4,909,284, and 5,806,569.

In a conventional dry crepe process, after web formation and drainage (to around 35% solids) in the forming section (assisted by centripetal force around the forming roll and, in some cases, vacuum boxes), a web is transferred from the forming fabric to a press fabric upon which the web is pressed between a rubber or polyurethane covered suction pressure roll and Yankee dryer. The press fabric is a permeable fabric designed to uptake water from the web as it is pressed in the press section. It is composed of large monofilaments or multi-filamentous yarns, needled with fine synthetic batt fibers to form a smooth surface for even web pressing against the Yankee dryer. Removing water via pressing reduces energy consumption.

In a conventional TAD process, rather than pressing and compacting the web, as is performed in conventional dry crepe, the web undergoes the steps of imprinting and thermal pre-drying. Imprinting is a step in the process where the web is transferred from a forming fabric to a structured fabric (or imprinting fabric) and subsequently pulled into the structured fabric using vacuum (referred to as imprinting or molding). This step imprints the weave pattern (or knuckle pattern) of the structured fabric into the web. This imprinting step increases softness of the web, and affects smoothness and the bulk structure. The manufacturing method of an imprinting fabric is similar to a forming fabric (see U.S. Pat. Nos. 3,473,576, 3,573,164, 3,905,863, 3,974,025, and 4,191,609 for examples) except for an additional step if an overlaid polymer is utilized.

Imprinting fabrics with an overlaid polymer are disclosed in U.S. Pat. Nos. 5,679,222, 4,514,345, 5,334,289, 4,528,239 and 4,637,859. Specifically, these patents disclose a method of forming a fabric in which a patterned resin is applied over a woven substrate. The patterned resin completely penetrates the woven substrate. The top surface of the patterned resin is flat and openings in the resin have sides that follow a linear path as the sides approach and then penetrate the woven structure.

U.S. Pat. Nos. 6,610,173, 6,660,362, 6,998,017, and European Patent No. EP 1 339 915 disclose another technique for applying an overlaid resin to a woven imprinting fabric.

After imprinting, the web is thermally pre-dried by moving hot air through the web while it is conveyed on the structured fabric. Thermal pre-drying can be used to dry the web to over 90% solids before the web is transferred to a steam heated cylinder. The web is then transferred from the structured fabric to the steam heated cylinder though a very low intensity nip (up to 10 times less than a conventional press nip) between a solid pressure roll and the steam heated cylinder. The portions of the web that are pressed between the pressure roll and steam cylinder rest on knuckles of the structured fabric; thereby protecting most of the web from the light compaction that occurs in this nip. The steam cylinder and an optional air cap system, for impinging hot air, then dry the sheet to up to 99% solids during the drying stage before creping occurs. The creping step of the process again only affects the knuckle sections of the web that are in contact with the steam cylinder surface. Due to only the knuckles of the web being creped, along with the dominant surface topography being generated by the structured fabric, and the higher thickness of the TAD web, the creping process has much smaller effect on overall softness as compared to conventional dry crepe. After creping, the web is optionally calendered and reeled into a parent roll and ready for the converting process. Some TAD machines utilize fabrics (similar to dryer fabrics) to support the sheet from the crepe blade to the reel drum to aid in sheet stability and productivity. Patents which describe creped through air dried products include U.S. Pat. Nos. 3,994,771, 4,102,737, 4,529,480, and 5,510,002.

The TAD process generally has higher capital costs as compared to a conventional tissue machine due to the amount of air handling equipment needed for the TAD section. Also, the TAD process has a higher energy consumption rate due to the need to burn natural gas or other fuels for thermal pre-drying. However, the bulk softness and absorbency of a paper product made from the TAD process is superior to conventional paper due to the superior bulk generation via structured fabrics, which creates a low density, high void volume web that retains its bulk when wetted. The surface smoothness of a TAD web can approach that of a conventional tissue web. The productivity of a TAD machine is less than that of a conventional tissue machine due to the complexity of the process and the difficulty of providing a robust and stable coating package on the Yankee dryer needed for transfer and creping of a delicate a pre-dried web.

UCTAD (un-creped through air drying) is a variation of the TAD process in which the sheet is not creped, but rather dried up to 99% solids using thermal drying, blown off the structured fabric (using air), and then optionally calendered and reeled. U.S. Pat. No. 5,607,551 describes an uncreped through air dried product.

A process/method and paper machine system for producing tissue has been developed by the Voith company and is marketed under the name ATMOS. The process/method and paper machine system has several variations, but all involve the use of a structured fabric in conjunction with a belt press. The major steps of the ATMOS process and its variations are stock preparation, forming, imprinting, pressing (using a belt press), creping, calendering (optional), and reeling the web.

The stock preparation step of the ATMOS process is the same as that of a conventional or TAD machine. The forming process can utilize a twin wire former (as described in U.S. Pat. No. 7,744,726), a Crescent Former with a suction Forming Roll (as described in U.S. Pat. No. 6,821,391), or a Crescent Former (as described in U.S. Pat. No. 7,387,706). The former is provided with a slurry from the headbox to a nip formed by a structured fabric (inner position/in contact with the forming roll) and forming fabric (outer position). The fibers from the slurry are predominately collected in the valleys (or pockets, pillows) of the structured fabric and the web is dewatered through the forming fabric. This method for forming the web results in a bulk structure and surface topography as described in U.S. Pat. No. 7,387,706 (FIGS. 1-11). After the forming roll, the structured and forming fabrics separate, with the web remaining in contact with the structured fabric.

The web is now transported on the structured fabric to a belt press. The belt press can have multiple configurations. The press dewaters the web while protecting the areas of the sheet within the structured fabric valleys from compaction. Moisture is pressed out of the web, through the dewatering fabric, and into the vacuum roll. The press belt is permeable and allows for air to pass through the belt, web, and dewatering fabric, and into the vacuum roll, thereby enhancing the moisture removal. Since both the belt and dewatering fabric are permeable, a hot air hood can be placed inside of the belt press to further enhance moisture removal. Alternately, the belt press can have a pressing device which includes several press shoes, with individual actuators to control cross direction moisture profile, or a press roll. A common arrangement of the belt press has the web pressed against a permeable dewatering fabric across a vacuum roll by a permeable extended nip belt press. Inside the belt press is a hot air hood that includes a steam shower to enhance moisture removal. The hot air hood apparatus over the belt press can be made more energy efficient by reusing a portion of heated exhaust air from the Yankee air cap or recirculating a portion of the exhaust air from the hot air apparatus itself.

After the belt press, a second press is used to nip the web between the structured fabric and dewatering felt by one hard and one soft roll. The press roll under the dewatering fabric can be supplied with vacuum to further assist water removal. This belt press arrangement is described in U.S. Pat. Nos. 8,382,956 and 8,580,083, with FIG. 1 showing the arrangement. Rather than sending the web through a second press after the belt press, the web can travel through a boost dryer, a high pressure through air dryer, a two pass high pressure through air dryer or a vacuum box with hot air supply hood. U.S. Pat. Nos. 7,510,631, 7,686,923, 7,931,781, 8,075,739, and 8,092,652 further describe methods and systems for using a belt press and structured fabric to make tissue products each having variations in fabric designs, nip pressures, dwell times, etc., and are mentioned here for reference. A wire turning roll can be also be utilized with vacuum before the sheet is transferred to a steam heated cylinder via a pressure roll nip.

The sheet is now transferred to a steam heated cylinder via a press element. The press element can be a through drilled (bored) pressure roll, a through drilled (bored) and blind drilled (blind bored) pressure roll, or a shoe press. After the web leaves this press element and before it contacts the steam heated cylinder, the % solids are in the range of 40-50%. The steam heated cylinder is coated with chemistry to aid in sticking the sheet to the cylinder at the press element nip and also to aid in removal of the sheet at the doctor blade. The sheet is dried to up to 99% solids by the steam heated cylinder and an installed hot air impingement hood over the cylinder. This drying process, the coating of the cylinder with chemistry, and the removal of the web with doctoring is explained in U.S. Pat. Nos. 7,582,187 and 7,905,989. The doctoring of the sheet off the Yankee, i.e., creping, is similar to that of TAD with only the knuckle sections of the web being creped. Thus, the dominant surface topography is generated by the structured fabric, with the creping process having a much smaller effect on overall softness as compared to conventional dry crepe. The web is now calendered (optional), slit, reeled and ready for the converting process.

The ATMOS process has capital costs between that of a conventional tissue machine and a TAD machine. It uses more fabrics and a more complex drying system compared to a conventional machine, but uses less equipment than a TAD machine. The energy costs are also between that of a conventional and a TAD machine due to the energy efficient hot air hood and belt press. The productivity of the ATMOS machine has been limited due to the inability of the novel belt press and hood to fully dewater the web and poor web transfer to the Yankee dryer, likely driven by poor supported coating packages, the inability of the process to utilize structured fabric release chemistry, and the inability to utilize overlaid fabrics to increase web contact area to the dryer. Poor adhesion of the web to the Yankee dryer has resulted in poor creping and stretch development which contributes to sheet handling issues in the reel section. The result is that the output of an ATMOS machine is currently below that of conventional and TAD machines. The bulk softness and absorbency is superior to conventional, but lower than a TAD web since some compaction of the sheet occurs within the belt press, especially areas of the web not protected within the pockets of the fabric. Also, bulk is limited since there is no speed differential to help drive the web into the structured fabric as exists on a TAD machine. The surface smoothness of an ATMOS web is between that of a TAD web and a conventional web primarily due to the current limitation on use of overlaid structured fabrics.

The ATMOS manufacturing technique is often described as a hybrid technology because it utilizes a structured fabric like the TAD process, but also utilizes energy efficient means to dewater the sheet like the conventional dry crepe process. Other manufacturing techniques which employ the use of a structured fabric along with an energy efficient dewatering process are the ETAD process and NTT process. The ETAD process and products are described in U.S. Pat. Nos. 7,339,378, 7,442,278, and 7,494,563. The NTT process and products are described in WO 2009/061079 A1, US Patent Application Publication No. 2011/0180223 A1, and US Patent Application Publication No. 2010/0065234 A1. The QRT process is described in US Patent Application Publication No. 2008/0156450 A1 and U.S. Pat. No. 7,811,418. A structuring belt manufacturing process used for the NTT, QRT, and ETAD imprinting process is described in U.S. Pat. No. 8,980,062 and U.S. Patent Application Publication No. US 2010/0236034.

The NTT process involves spirally winding strips of polymeric material, such as industrial strapping or ribbon material, and adjoining the sides of the strips of material using ultrasonic, infrared, or laser welding techniques to produce an endless belt. Optionally, a filler or gap material can be placed between the strips of material and melted using the aforementioned welding techniques to join the strips of materials. The strips of polymeric material are produced by an extrusion process from any polymeric resin such as polyester, polyamide, polyurethane, polypropylene, or polyether ether ketone resins. The strip material can also be reinforced by incorporating monofilaments of polymeric material into the strips during the extrusion process or by laminating a layer of woven polymer monofilaments to the non-sheet contacting surface of a finished endless belt composed of welded strip material. The endless belt can have a textured surface produced using processes such as sanding, graving, embossing, or etching. The belt can be impermeable to air and water, or made permeable by processes such as punching, drilling, or laser drilling. Examples of structuring belts used in the NTT process can be viewed in International Publication Number WO 2009/067079 A1 and US Patent Application Publication No. 2010/0065234 A1.

As shown in the aforementioned discussion of tissue papermaking technologies, the fabrics or belts utilized are critical in the development of the tissue web structure and topography which, in turn, are instrumental in determining the quality characteristics of the web such as softness (bulk softness and surfaces smoothness) and absorbency. The manufacturing process for making these fabrics has been limited to weaving a fabric (primarily forming fabrics and structured fabrics) or a base structure and needling synthetic fibers (press fabrics) or overlaying a polymeric resin (overlaid structured fabrics) to the fabric/base structure, or welding strips of polymeric material together to form an endless belt.

Conventional overlaid structures require application of an uncured polymer resin over a woven substrate where the resin completely penetrates through the thickness of the woven structure. Certain areas of the resin are cured and other areas are uncured and washed away from the woven structure. This results in a fabric where airflow through the fabric is only possible in the Z-direction. Thus, in order for the web to dry efficiently, only highly permeable fabrics can be utilized, meaning the amount of overlaid resin applied needs to be limited. If a fabric of low permeability is produced in this manner, then drying efficiency is significantly reduced, resulting in poor energy efficiency and/or low production rates as the web must be transported slowly across the TAD drums or ATMOS drum for sufficient drying. Similarly, a welded polymer structuring layer is extremely planar and provides an even surface when laminating to a woven support layer (FIG. 9), which results in little if any air channels in the X-Y plane.

SUMMARY OF THE INVENTION

An object of this invention is to provide an alternate process for manufacturing structured fabrics. It is also the purpose of this invention to provide a less complex, lower cost, higher production technique to produce these fabrics. This process can be used to produce structuring fabrics and forming fabrics.

In an exemplary embodiment, the inventive process uses extruded polymeric netting material to create the fabric. The extruded polymer netting is optionally laminated to additional layers of extruded polymer netting, woven polymer monofilament, or woven monofilaments or multi-filamentous yarns needled with fine synthetic batt fibers.

Another object of this invention is to provide a press section of a paper machine that can utilize the inventive structuring fabric to produce high quality, high bulk tissue paper. This press section combines the low capital cost, high production rate, low energy consumption advantages of the NTT manufacturing process, but improves the quality to levels that can be achieved with TAD technology.

The inventive process avoids the tedious and expensive conventional prior art process used to produce woven fabrics using a loom or the time, cost, and precision needed to produce welded fabrics using woven strips of polymeric material that need to be engraved, embossed, or laser drilled. The fabrics produced using the inventive process can be utilized as forming fabrics on any papermaking machine or as a structuring belt on tissue machines utilizing the TAD (creped or uncreped), NTT, QRT, ATMOS, ETAD or other hybrid processes.

In an exemplary embodiment, a low porosity structuring belt of the inventive design is used on a TAD machine where the air flows through the TAD drum from a hot air impingement hood or air cap. High air flow through the inventive structuring belt is not required to effectively dry the imprinted sheet, leading to lower heat demand and fuel consumption.

In an exemplary embodiment, a press section of a tissue machine can be used in conjunction with structured fabrics of this invention to produce high quality tissue with low capital and operational costs. This combination of high quality tissue produced at high productivity rates using low capital and operational costs is not currently available using conventional technologies.

According to an exemplary embodiment of the present invention, a fabric or belt for a papermaking machine comprises: a first layer that defines a web contacting surface, the first layer being made of extruded polymer and comprising: a plurality of first elements aligned in a first direction; a plurality of second elements aligned in a second direction and extending over the plurality of first elements; and a plurality of open portions defined by the plurality of first and second elements; and a second layer made of woven fabric that supports the first layer, wherein the first layer is bonded to the second layer so that the first layer extends only partially through the second layer and an interface formed between the first and second layers comprises airflow channels that extend in a plane parallel to the first and second layers.

According to at least one exemplary embodiment, the interface between the first and second layers comprises bonded and non-bonded portions.

According to at least one exemplary embodiment, the first layer extends into the second layer by an amount of 30 μm or less.

According to at least one exemplary embodiment, the first layer has a thickness of 0.25 mm to 1.7 mm.

According to at least one exemplary embodiment, the first layer has a thickness of 0.4 mm to 0.75 mm.

According to at least one exemplary embodiment, the first layer has a thickness of 0.5 mm to 0.6 mm.

According to at least one exemplary embodiment, the plurality of open portions repeat across the first layer in both machine and cross directions at regular intervals.

According to at least one exemplary embodiment, the plurality of open portions are rectangular-shaped open portions.

According to at least one exemplary embodiment, the rectangular-shaped open portions are defined by sides with a length of 0.25 mm to 1.0 mm.

According to at least one exemplary embodiment, the rectangular-shaped open portions are defined by sides with a length of 0.4 mm to 0.75 mm.

According to at least one exemplary embodiment, the rectangular-shaped open portions are defined by sides with a length of 0.5 mm to 0.7 mm.

According to at least one exemplary embodiment, the plurality of open portions are square-shaped open portions.

According to at least one exemplary embodiment, the plurality of open portions are circular-shaped open portions.

According to at least one exemplary embodiment, the diameter of the circular-shaped open portions is 0.25 mm to 1.0 mm.

According to at least one exemplary embodiment, the diameter of the circular-shaped open portions is 0.4 mm to 0.75 mm.

According to at least one exemplary embodiment, the diameter of the circular-shaped open portions is 0.1 mm to 0.7 mm.

According to at least one exemplary embodiment, the plurality of second elements extend above the plurality of first elements by an amount of 0.05 mm to 0.40 mm.

According to at least one exemplary embodiment, the plurality of second elements extend above the plurality of first elements by an amount of 0.1 mm to 0.3 mm.

According to at least one exemplary embodiment, the plurality of second elements extend above the plurality of first elements by an amount of 0.1 mm to 0.2 mm.

According to at least one exemplary embodiment, the plurality of second elements have a width of 0.1 mm to 0.5 mm.

According to at least one exemplary embodiment, the plurality of second elements have a width of 0.2 mm to 0.4 mm.

According to at least one exemplary embodiment, the plurality of second elements have a width of 0.25 mm to 0.3 mm.

According to at least one exemplary embodiment, the plurality of first elements have a thickness of 0.15 mm to 0.75 mm.

According to at least one exemplary embodiment, the plurality of first elements have a thickness of 0.3 mm to 0.6 mm.

According to at least one exemplary embodiment, the plurality of first elements have a thickness of 0.4 mm to 0.6 mm.

According to at least one exemplary embodiment, the plurality of first elements have a width of 0.25 mm to 1.0 mm.

According to at least one exemplary embodiment, the plurality of first elements have a width of 0.3 mm to 0.5 mm.

According to at least one exemplary embodiment, the plurality of first elements have a width of 0.4 mm to 0.5 mm.

According to at least one exemplary embodiment, the first layer is made of polymer or copolymer.

According to at least one exemplary embodiment, the first layer is made of an extruded netting tube.

According to at least one exemplary embodiment, the extruded netting tube is stretched to orient the polymer or copolymer.

According to at least one exemplary embodiment, the first layer is made of a perforated sheet.

According to at least one exemplary embodiment, the perforated sheet is stretched to orient the polymer or copolymer.

According to at least one exemplary embodiment, the perforated sheet is seamed using thermal, laser, infrared or ultraviolet seaming.

According to at least one exemplary embodiment, the second layer comprises woven polymeric monofilaments.

According to at least one exemplary embodiment, the second layer comprises woven monofilaments or multifilamentous yarns needled with fine synthetic batt fibers.

According to at least one exemplary embodiment, the second layer has a 5 shed weave with a non-numerical warp pick sequence.

According to at least one exemplary embodiment, the second layer has a mesh of 10 to 30 frames/cm.

According to at least one exemplary embodiment, the second layer has a mesh of 15 to 25 frames/cm.

According to at least one exemplary embodiment, the second layer has a mesh of 17 to 22 frames/cm.

According to at least one exemplary embodiment, the second layer has a count of 5 to 30 frames/cm.

According to at least one exemplary embodiment, the second layer has a count of 10 to 20 frames/cm.

According to at least one exemplary embodiment, the second layer has a count of 15 to 20 frames/cm.

According to at least one exemplary embodiment, the second layer has a caliper of 0.5 mm to 1.5 mm.

According to at least one exemplary embodiment, the second layer has a caliper of 0.5 mm to 1.0 mm.

According to at least one exemplary embodiment, the second layer has a caliper of 0.5 mm to 0.75 mm.

According to at least one exemplary embodiment, the second layer is bonded to the first layer by thermal, ultrasonic, ultraviolet or infrared welding.

According to at least one exemplary embodiment, the second layer is bonded to the first layer with a 20% to 50% contact area.

According to at least one exemplary embodiment, the second layer is bonded to the first layer with a 20% to 30% contact area.

According to at least one exemplary embodiment, the second layer is bonded to the first layer with a 25% to 30% contact area.

According to at least one exemplary embodiment, the fabric or belt has an air permeability of 20 cfm to 300 cfm.

According to at least one exemplary embodiment, the fabric or belt has an air permeability of 100 cfm to 250 cfm.

According to at least one exemplary embodiment, the fabric or belt has an air permeability of 200 cfm to 250 cfm.

According to at least one exemplary embodiment, the fabric or belt is a structuring fabric configured for use on a papermaking machine.

According to at least one exemplary embodiment, the papermaking machine is a Through Air Dried, ATMOS, NTT, QRT or ETAD tissue making machine.

According to at least one exemplary embodiment, the fabric or belt is a forming fabric configured for use on a papermaking machine.

According to at least one exemplary embodiment, the plurality of second elements extend below the plurality of first elements.

According to at least one exemplary embodiment, the plurality of second elements extend below the plurality of first elements by less than 0.40 mm.

According to at least one exemplary embodiment, the plurality of second elements extend below the plurality of first elements by 0.1 mm to 0.3 mm.

According to at least one exemplary embodiment, the plurality of second elements extend below the plurality of first elements by 0.1 mm to 0.2 mm.

According to at least one exemplary embodiment, the first direction is substantially parallel to a machine cross direction.

According to at least one exemplary embodiment, the second direction is substantially parallel to a machine direction.

According to at least one exemplary embodiment, the first direction is substantially parallel to a machine direction.

According to at least one exemplary embodiment, the second direction is substantially parallel to a machine cross direction.

A fabric or belt for a papermaking machine according to an exemplary embodiment of the present invention comprises: a first layer that defines a web contacting surface, the first layer being made of extruded polymer and comprising: a plurality of first elements aligned in a first direction; a plurality of second elements aligned in a second direction and extending over the plurality of first elements; and a plurality of open portions defined by the plurality of first and second elements; and a second layer made of woven fabric that supports the first layer, wherein the first layer is bonded to the second layer so as to form an interface between the first and second layers that comprises bonded and unbonded portions and airflow channels that extend in a plane parallel to the first and second layers.

According to at least one exemplary embodiment, the first layer extends only partially through the second layer.

According to at least one exemplary embodiment, the first layer extends into the second layer by an amount of 30 μm or less.

A fabric or belt for a papermaking machine according to an exemplary embodiment of the present invention comprises: a first layer that defines a web contacting surface, the first layer comprising a plurality of grooves aligned substantially in the machine direction; and a second layer made of woven fabric that supports the first layer, wherein the first layer is bonded to the second layer so as to form an interface between the first and second layers that comprises bonded and unbonded portions and airflow channels that extend in a plane parallel to the first and second layers.

According to at least one exemplary embodiment, the plurality of grooves are angled 0.1% to 45% relative to the machine direction.

According to at least one exemplary embodiment, the plurality of grooves are angled 0.1% to 5% relative to the machine direction.

According to at least one exemplary embodiment, the plurality of grooves are angled 2% to 3% relative to the machine direction.

According to at least one exemplary embodiment, the plurality of grooves have a depth of 0.25 mm to 1.0 mm.

According to at least one exemplary embodiment, the plurality of grooves have a depth of 0.4 mm to 0.75 mm.

According to at least one exemplary embodiment, the plurality of grooves have a depth of 0.4 mm to 0.6 mm.

According to at least one exemplary embodiment, the plurality of grooves have a square, semicircular or tapered cross section.

According to at least one exemplary embodiment, the plurality of grooves are spaced 0.1 mm to 1.5 mm apart from each other.

According to at least one exemplary embodiment, the plurality of grooves are spaced 0.2 mm to 0.5 mm apart from each other.

According to at least one exemplary embodiment, the plurality of grooves are spaced 0.2 mm to 0.3 mm apart from each other.

According to at least one exemplary embodiment, the plurality of grooves are formed by laser drilling.

According to at least one exemplary embodiment, the fabric or belt is subjected to punching, drilling or laser drilling to achieve an air permeability of 20 cfm to 200 cfm.

According to at least one exemplary embodiment, the fabric or belt has an air permeability of 20 cfm to 100 cfm.

According to at least one exemplary embodiment, the fabric or belt has an air permeability of 10 cfm to 50 cfm.

A fabric or belt for a papermaking machine according to an exemplary embodiment of the present invention comprises: first layer that defines a web contacting surface, the first layer comprising: a plurality of first elements aligned in a cross direction, the plurality of first elements having a thickness of 0.3 mm to 0.6 mm and a width of 0.4 mm to 0.5 mm; a plurality of second elements aligned in a machine direction and extending over the plurality of first elements by an amount of 0.1 mm to 0.2 mm and having a width of 0.25 mm to 0.3 mm; and a plurality of open portions defined by the plurality of first and second elements and that repeat across the at least one nonwoven layer in both the machine and cross directions at regular intervals, the plurality of open portions being square shaped and defined by sides with a length of 0.5 mm to 0.7 mm; and a woven fabric layer that supports the at least one layer, wherein the fabric or belt has an air permeability of 20 cfm to 300 cfm.

A fabric or belt for a papermaking machine according to an exemplary embodiment of the present invention comprises: at least one layer that defines a web contacting surface, the at least one layer comprising: a plurality of first elements aligned in a cross direction, the plurality of first elements having a thickness of 0.3 mm to 0.6 mm and a width of 0.4 mm to 0.5 mm; a plurality of second elements aligned in a machine direction and extending over the plurality of first elements by an amount of 0.1 mm to 0.2 mm and having a width of 0.25 mm to 0.3 mm; and a plurality of open portions defined by the plurality of first and second elements and that repeat across the at least one layer in both the machine and cross directions at regular intervals, the plurality of open portions being circular shaped with a diameter of 0.5 mm to 0.7 mm; and a woven fabric layer that supports the at least one layer, wherein the fabric or belt has an air permeability of 20 cfm to 300 cfm.

A method of forming a tissue product according to an exemplary embodiment of the present invention comprises: depositing a nascent paper web onto a forming fabric of a papermaking machine so as to form a paper web; at least partially dewatering the paper web through a structuring fabric of a press section of the papermaking machine, wherein the structuring fabric comprises: a first layer that defines a web contacting surface, the first layer being made of extruded polymer and comprising: a plurality of first elements aligned in a first direction; a plurality of second elements aligned in a second direction and extending over the plurality of first elements; and a plurality of open portions defined by the plurality of first and second elements; and a second layer made of woven fabric that supports the first layer, wherein the first layer is bonded to the second layer so that the first layer extends only partially through the second layer and an interface formed between the first and second layers comprise airflow channels that extend in a plane parallel to the first and second layers; and drying the at least partially dewatered paper web at a drying section of the papermaking machine.

BRIEF DESCRIPTION OF THE DRAWINGS

The features and advantages of exemplary embodiments of the present invention will be more fully understood with reference to the following, detailed description when taken in conjunction with the accompanying figures, wherein:

FIGS. 17A and 17B are tables providing various attributes of commercially available products as compared to those of Example 1; and FIGS. 18A-18C are tables providing various attributes of Comparative Example 3, Example 2 and commercially available products.

DETAILED DESCRIPTION

Figure 1:
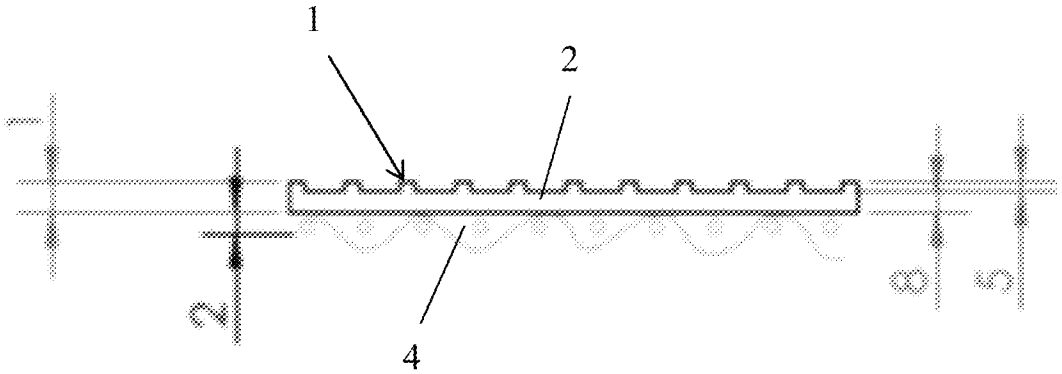
FIG. 1 is a cross-sectional view of a fabric or belt according to an exemplary embodiment of the present invention.

Current methods for manufacturing papermaking fabrics are very time consuming and expensive, requiring weaving together polymer monofilaments using a loom and optionally binding a polymer overlay, or binding strips of polymeric ribbon material together using ultrasonic, infrared, or ultraviolet welding techniques. According to an exemplary embodiment of the present invention, a layer of extruded polymeric material is formed separately from a woven fabric layer, and the layer of polymeric material is attached to the woven fabric layer to form the fabric or belt structure. The layer of polymeric material includes elevated elements that extend substantially in the machine direction or cross direction.

In an exemplary embodiment, the layer of polymeric material is extruded polymer netting. Extruded netting tubes were first manufactured around 1956 in accordance with the process described in U.S. Pat. No. 2,919,467. The process creates a polymer net which in general has diamond shaped openings extending along the length of the tube. Since this process was pioneered, it has grown tremendously, with extruded square netting tubes being described in U.S. Pat. Nos. 3,252,181, 3,384,692, and 4,038,008. Nets can also be extruded in flat sheets as described in U.S. Pat. No. 3,666,609 which are then perforated or embossed to a selected geometric configuration. Heating and stretching the netting is conducted to enlarge the openings in the net structure and orient the polymers to increase strength. Tube netting can be stretched over a cylindrical mandrel while both tube and flat sheet netting can be stretched in the longitudinal and transverse directions using several techniques. U.S. Pat. No. 4,190,692 describes a process of stretching the netting to orient the polymer and increase strength.

Today, various types of polymers can be extruded to provide the optimal level of strength, stretch, heat resistance, abrasion resistance and a variety of other physical properties. Polymers can be coextruded in layers allowing for an adhesive agent to be incorporated into the outer shell of the netting to facilitate thermal lamination of multiple layers of netting.

According to an exemplary embodiment of the present invention, extruded netted tubes are used in fabrics in the papermaking process to lower the material cost, improve productivity, and improve product quality. The positions where this type of fabric can have the most impact are as the forming fabrics of any paper machine or as the structuring fabric on Through Air Dried (creped or uncreped), ATMOS, NTT, QRT or ETAD tissue paper making machines.

The extruded netted tubes have openings that are square, diamond, circular, or any geometric shape that can be produced with the dye equipment used in the extrusion process. The netted tubes are composed of any combination of polymers necessary to develop the stretch, strength, heat resistance, and abrasion resistance necessary for the application. Additionally, coextrusion is preferred with an adhesive agent incorporated into the outer shell of the netting. The adhesive agent facilitates thermal lamination of multiple layers of netting, thermal lamination of netting to woven monofilaments, or thermal lamination of netting to woven monofilaments or multi-filamentous yarns needled with fine synthetic batt fibers. The netting is preferably stretched across a cylindrical mandrel to orient the polymers for increased strength and control over the size of the openings in the netting.

Netting that has been extruded in flat sheets and perforated with openings in the preferred geometric shapes can also be utilized. These nettings are preferably coextruded with an adhesive agent incorporated into the outer shell of the netting to facilitate thermal lamination of multiple layers of netting, thermal lamination of netting to woven monofilaments, or thermal lamination of netting to woven monofilaments or multi-filamentous yarns needled with fine synthetic batt fibers. The netting is preferable heated and stretched in the longitudinal and transverse direction to control the size of the opening and increase strength of the net. When flat netting is utilized, seaming is used to produce an endless tube. Seaming techniques using a laser or ultrasonic welding are preferred.

Figure 2:
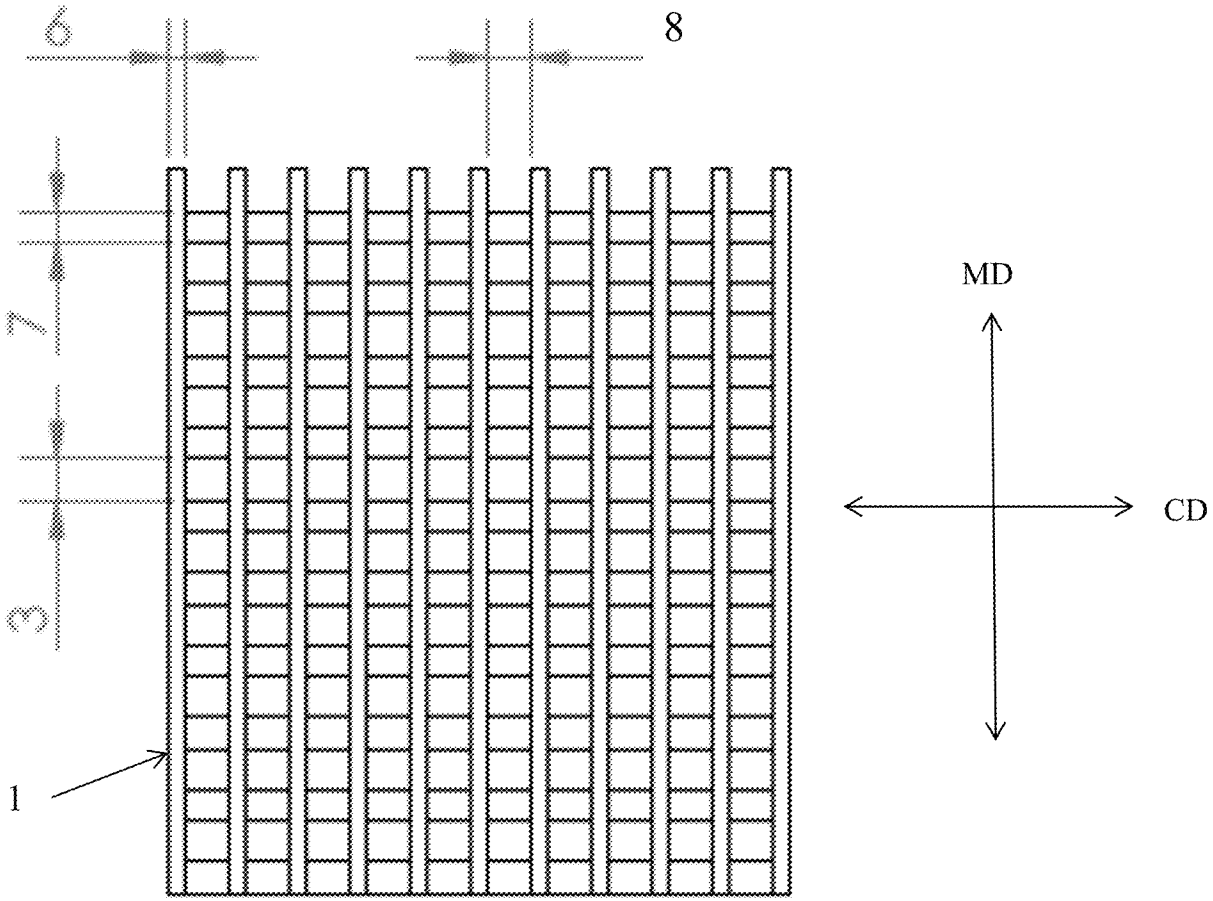
FIG. 2 is a top planar view of the fabric or belt of FIG. 1.

FIG. 1 is a cross-sectional view and FIG. 2 is a top planar view of a structuring belt or fabric, generally designated by reference number 1, according to an exemplary embodiment of the present invention. The belt or fabric 1 is multilayered and includes a layer 2 that forms the side of the belt or fabric carrying the paper web, and a woven fabric layer 4 forming the non-paper web contacting side of the belt or fabric. The layer 2 is comprised of netted tube of coextruded polymer with a thickness (1) of 0.25 mm to 1.7 mm, with openings being regularly recurrent and distributed in the longitudinal (MD) and cross direction (CD) of the layer 2 or substantially parallel (plus or minus 10 degrees) thereto. The openings are square with a width (8) and length (3) between 0.25 to 1.0 mm or circular with a diameter between 0.25 to 1.0 mm. The MD aligned elements of the netting of the layer 2 extend (5) 0.05 to 0.40 mm above the top plane of the CD aligned elements of the netting. The CD aligned elements of the netting of the structuring layer 2 have a thickness (8) of 0.34 mm. The widths (6) of the MD aligned elements of the netting of the layer 2 are between 0.1 to 0.5 mm. The widths (7) of the CD aligned elements are between 0.25 to 1.0 mm, as well. The two layers 2, 4 are laminated together using heat to melt the adhesive in the polymer of the layer 2. Ultrasonic, infrared, and laser welding can also be utilized to laminate the layers 2, 4. As discussed in further detail below, the lamination of the two layers results in the layer 2 extending only partially through the thickness of the woven fabric layer 4, with some portions of the layer 2 remaining unbonded to the woven fabric layer 4.

Figure 10:
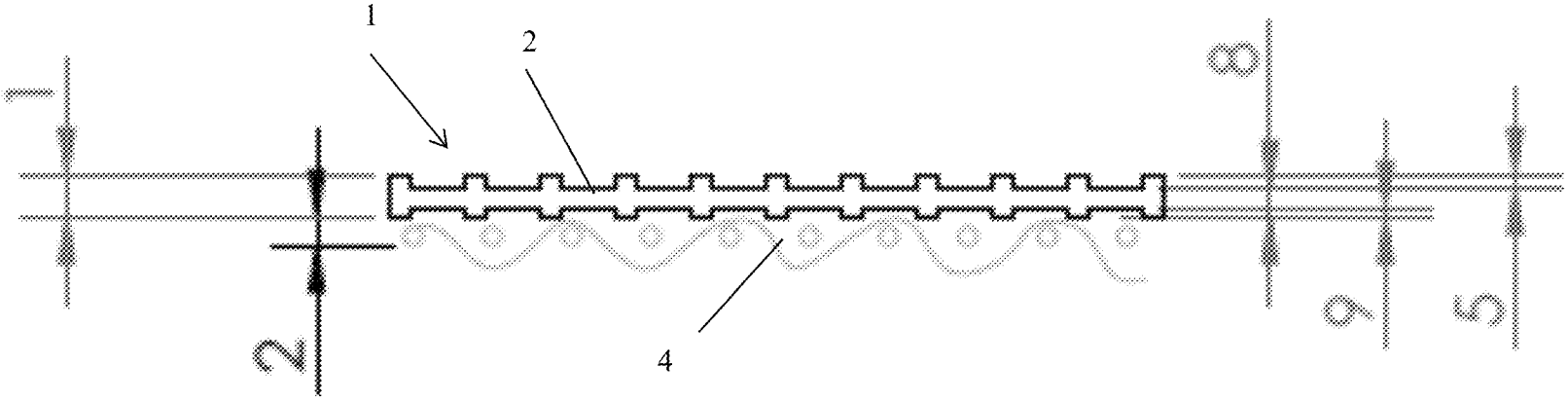
FIG. 10 is a cross-sectional view of a fabric or belt according to an exemplary embodiment of the present invention.

Optionally, as shown in FIG. 10, the MD aligned elements of the netting of the layer 1 can extend (9) up to 0.40 mm below the bottom plane of the CD aligned portion of the netting to further aid in air flow in the X-Y plane of the fabric or belt and supported web. In other embodiments, the elements described above as being MD and CD aligned elements may be aligned to the opposite axis or aligned off axis from the MD and/or CD directions.

The woven fabric layer 4 is comprised of a woven polymeric fabric with a preferred mesh of between 10-30 frames/cm, a count of 5 to 30 frames/cm, and a caliper from 0.5 mm to 1.5 mm. This layer preferably has a five shed non numerical consecutive warp-pick sequence (as described in U.S. Pat. No. 4,191,609) that is sanded to provide 20 to 50 percent contact area with the layer 2. The fabric or belt 1 with a woven fabric layer 4 of this design is suitable on any TAD or ATMOS asset. Optionally, the woven fabric layer 4 is composed of woven monofilaments or multi-filamentous yarns needled with fine synthetic batt fibers similar to a standard press fabric used in the conventional tissue papermaking press section. The fabric or belt 1 with a woven fabric layer 4 of this design is suitable on any NTT, QRT, or ETAD machine.

Figure 6:
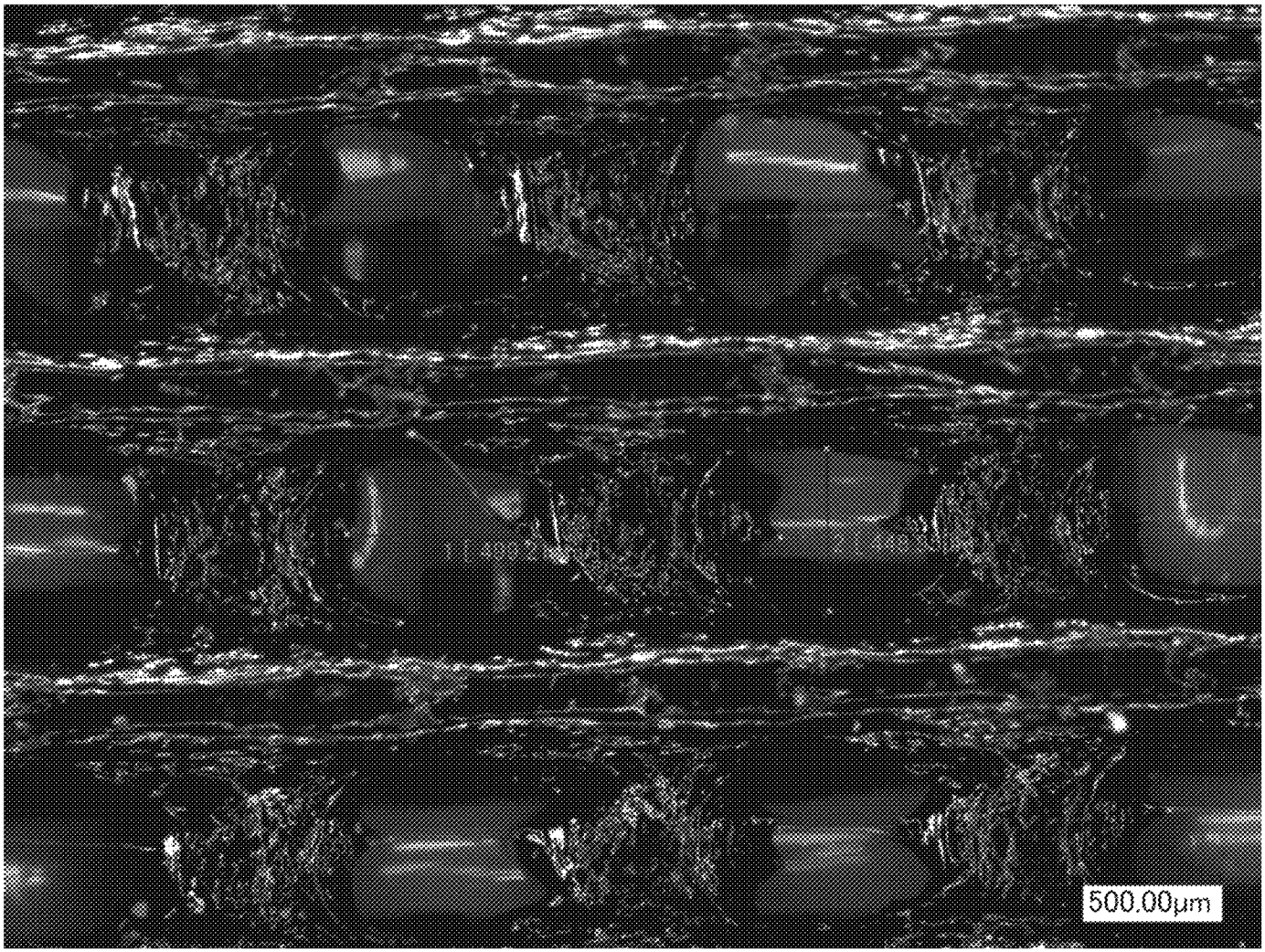
FIG. 6 is a photo showing a magnified image of a fabric or belt according to an exemplary embodiment of the present invention.
Figure 7:
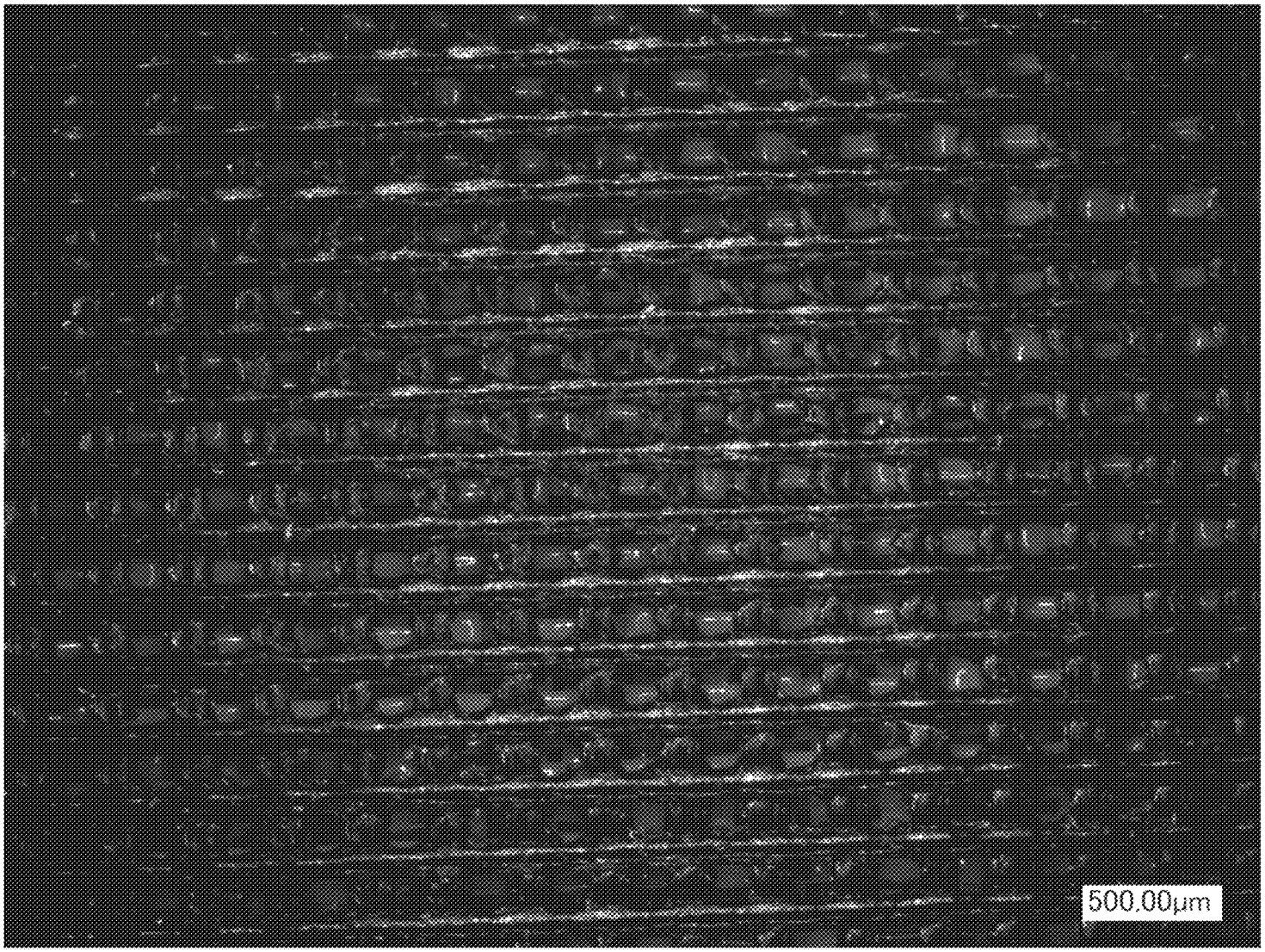
FIG. 7 is a photo of a fabric or belt according to an exemplary embodiment of the present invention.
Figure 8:
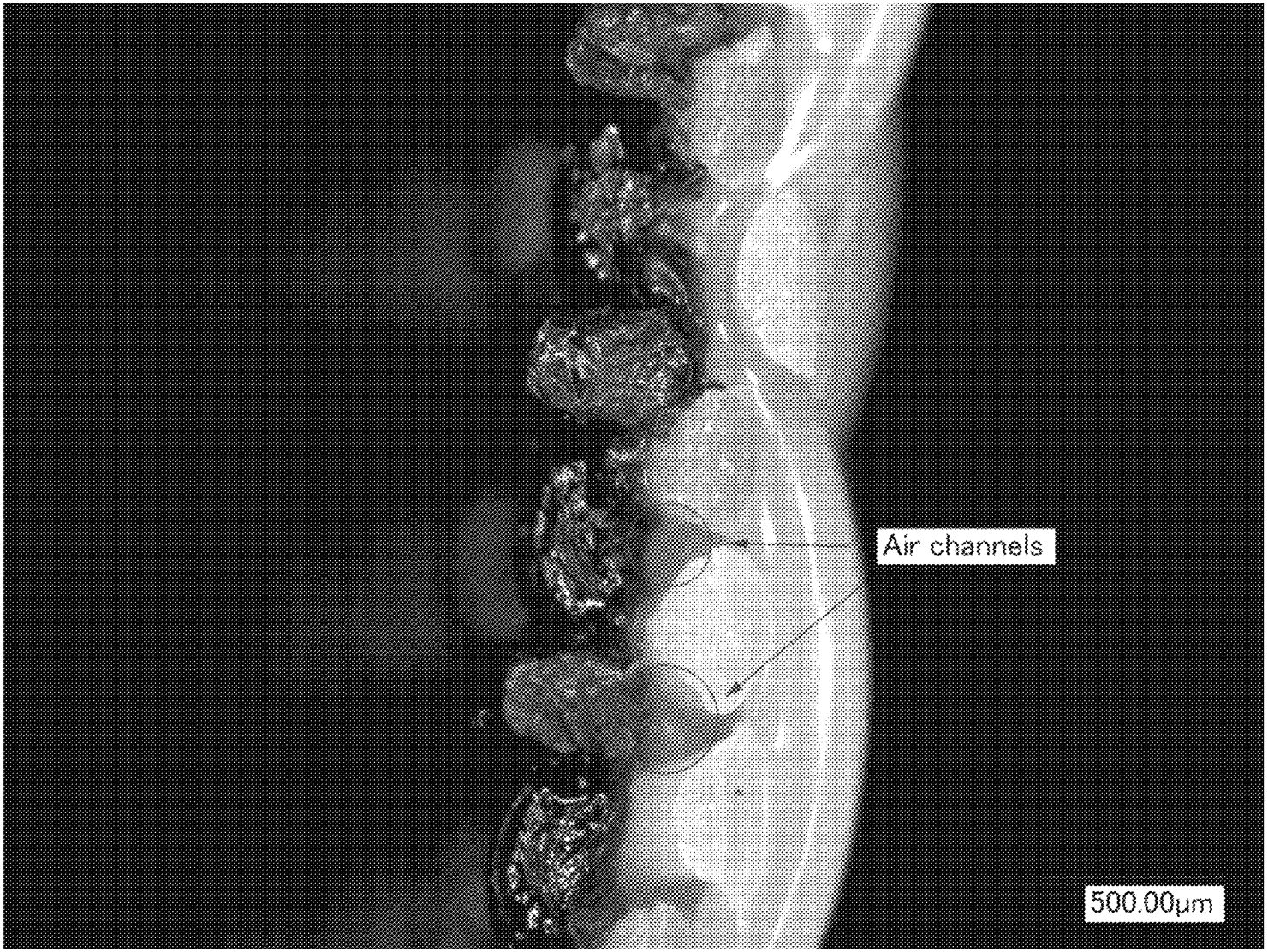
FIG. 8 is a photo showing air channels formed in the fabric or belt according to an exemplary embodiment of the present invention.
Figure 9:
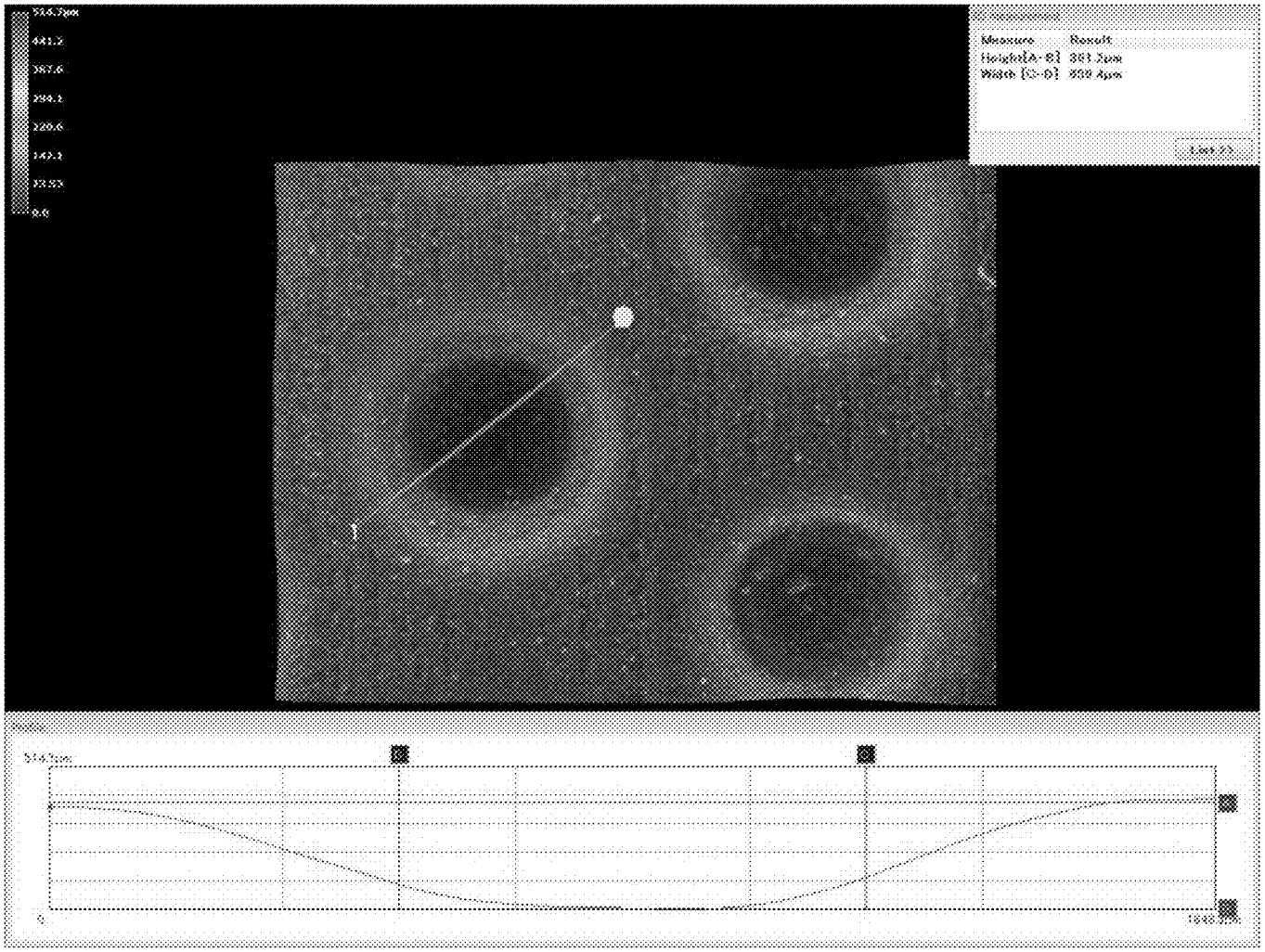
CONVENTIONAL ART FIG. 9
FIG. 9 is a photo of a welded polymer structuring layer according to the conventional art.
Figure 11:
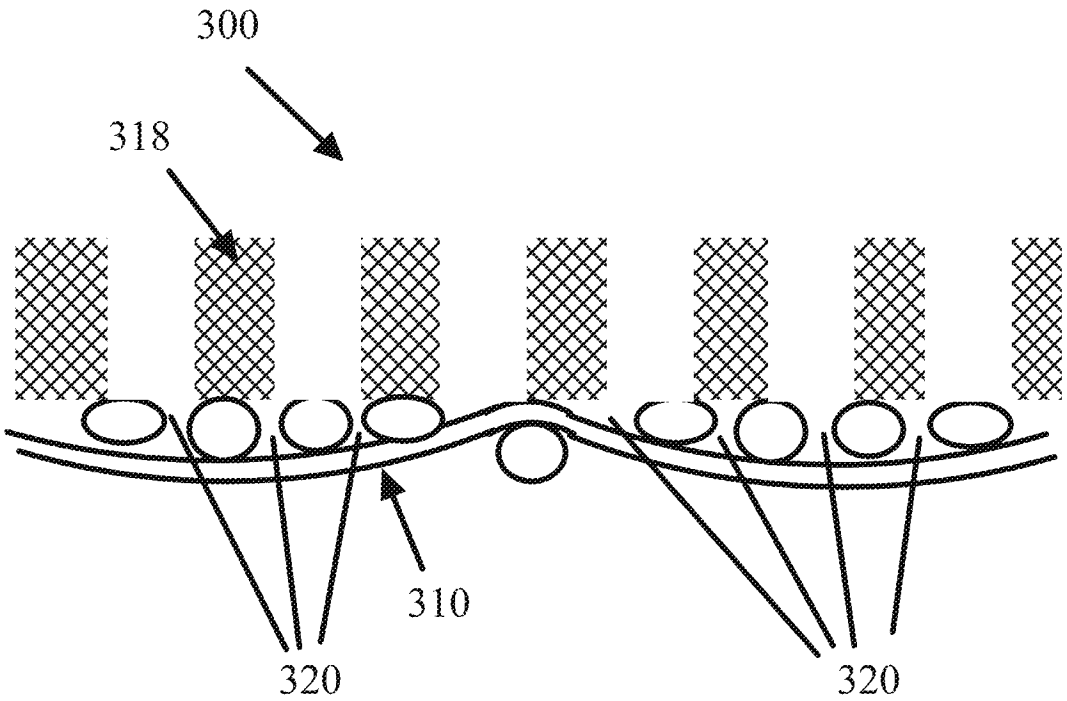
FIG. 11 is a cross-sectional view of a fabric or belt according to an exemplary embodiment of the present invention.
Figure 12:
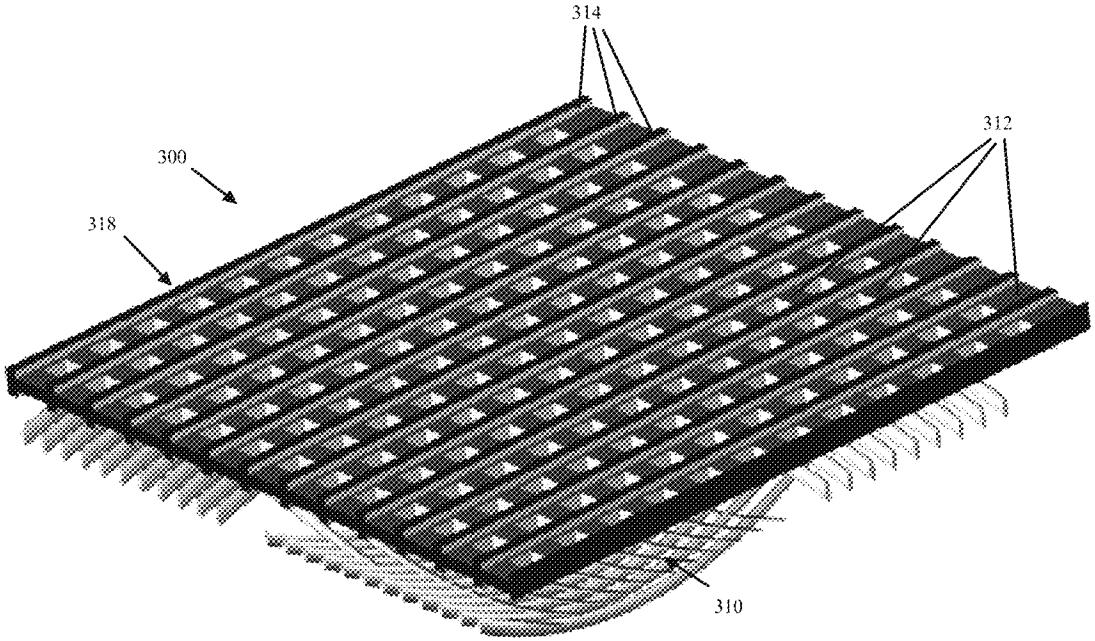
FIG. 12 is a sectional perspective view of a fabric or belt according to an exemplary embodiment of the present invention.

FIGS. 6-8 are photographs, FIG. 11 is a cross-sectional view and FIG. 12 is a perspective view of a belt or fabric, generally designated by reference number 300, according to an exemplary embodiment of the present invention. The belt or fabric 300 is produced by laminating an already cured polymer netted layer 318 to a woven fabric layer 310. The polymer netted layer 318 includes CD aligned elements 314 and MD aligned elements 312. The CD aligned elements 314 and the MD aligned elements 312 cross one another with spaces between adjacent elements so as to form openings. As best shown in the photographs of FIGS. 6-8, both the extruded polymer netting layer 318 and woven layer 310 have non-planar, irregularly shaped surfaces that when laminated together only bond together where the two layers come into direct contact. The lamination results in the extruded polymer layer 318 extending only partially into the woven layer 310 so that any bonding that takes place between the two layers occurs at or near the surface of the woven layer 310. In a preferred embodiment, the extruded polymer layer 318 extends into the woven layer 310 to a depth of 30 microns or less. As shown in FIG. 11, the partial and uneven bonding between the two layers results in formation of air channels 320 that extend in the X-Y plane of the fabric or belt 300. This in turn allows air to travel in the X-Y plane along a sheet (as well as within the fabric or belt 300) being held by the fabric or belt 300 during TAD, UCTAD, or ATMOS processes. Without being bound by theory, it is believed that the fabric or belt 300 removes higher amounts of water due to the longer airflow path and dwell time as compared to conventional designs. In particular, previously known woven and overlaid fabric designs create channels where airflow is restricted in movement in regards to the X-Y direction and channeled in the Z-direction by the physical restrictions imposed by pockets formed by the monofilaments or polymers of the belt. The inventive design allows for airflow in the X-Y direction, such that air can move parallel through the belt and web across multiple pocket boundaries and increase contact time of the airflow within the web to remove additional water. This allows for the use of belts with lower permeability compared to conventional fabrics without increasing the energy demand per ton of paper dried. The air flow in the X-Y plane also reduces high velocity air flow in the Z-direction as the sheet and fabric pass across the molding box, thereby reducing the formation of pin holes in the sheet.

In an exemplary embodiment, the woven layer 310 is composed of polyethylene terephthalate (PET). Conventional non-overlaid structuring fabrics made of PET typically have a failure mode in which fibrillation of the sheet side of the monofilaments occurs due to high pressure from cleaning showers, compression at the pressure roll nip, and heat from the TAD, UCTAD, or ATMOS module. The non-sheet side typically experiences some mild wear and loss of caliper due to abrasion across the paper machine rolls and is rarely the cause of fabric failure. By contrast, the extruded polymer layer 318 is composed of polyurethane, which has higher impact resistance as compared to PET to better resist damage by high pressure showers. It also has higher load capacity in both tension and compression such that it can undergo a change in shape under a heavy load but return to its original shape once the load is removed (which occurs in the pressure roll nip). Polyurethane also has excellent flex fatigue resistance, tensile strength, tear strength, abrasion resistance, and heat resistance. These properties allow the fabric to be durable and run longer on the paper machine than a standard woven fabric. Additionally the woven structure can be sanded to increase the surface area that contacts the extruded polymer layer to increase the total bonded area between the two layers. Varying the degree of sanding of the woven structure can alter the bonded area from 10% to up to 50% of the total surface area of the woven fabric that lies beneath the extruded polymer layer. The preferred bonded area is approximately 20-30% which provides sufficient durability to the fabric without closing excessive amounts of air channels in the X-Y plane of the fabric, which in turn maintains improved drying efficiency compared to conventional fabrics.

Figure 3:
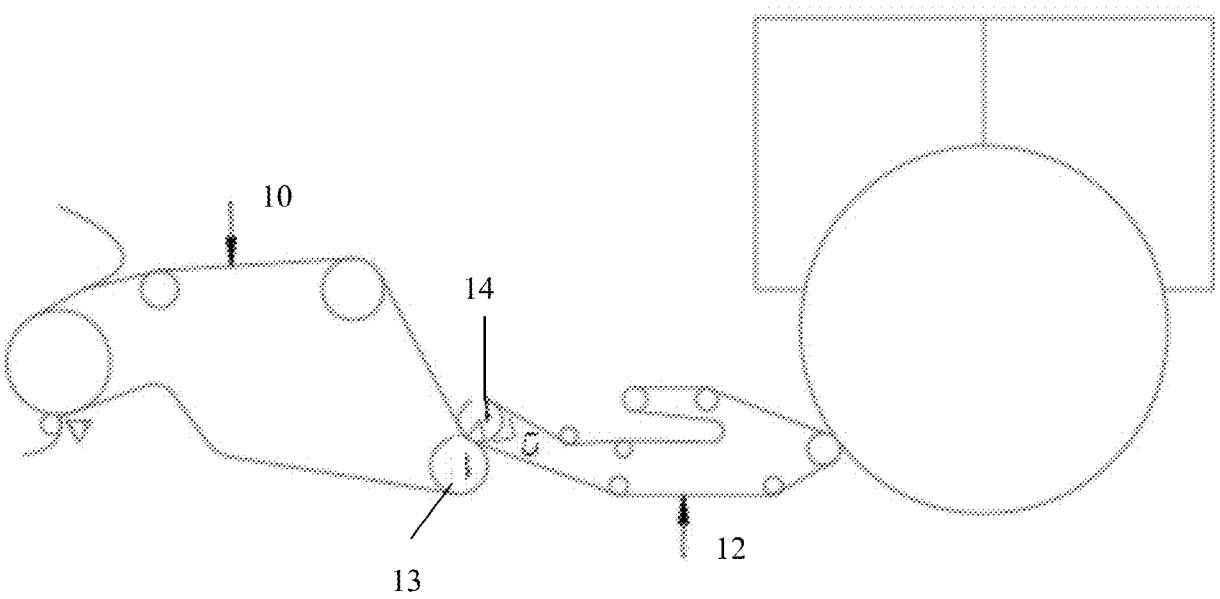
FIG. 3 is a block diagram of a press section according to an exemplary embodiment of the present invention.

FIG. 3 shows a press section according to an exemplary embodiment of the present invention. The press section is similar to the press section described in US Patent Application Publication No. 2011/0180223 except the press is comprised of suction pressure roll 14 and an extended nip or shoe press 13. A paper web, supported upon a press fabric 10 composed of woven monofilaments or multi-filamentous yarns needled with fine synthetic batt fibers, is transported through this press section nip and transferred to the structuring belt 12. The structuring belt 12 is comprised of a structuring layer of extruded netting or welded polymeric strips made permeable with holes formed by laser drilling (or other suitable mechanical processes) and laminated to a support layer comprised of woven monofilaments or multi-filamentous yarns needled with fine synthetic batt fibers. The support layer is preferably comprised of a material typical of a press fabric used on a conventional tissue machine. The paper web is dewatered through both sides of the sheet into the press fabric 10 and structuring fabric 12 as the web passes through the nip of the press section. The suction pressure roll 14 is preferably a through drilled, blind drilled, and/or grooved polyurethane covered roll.

This press section improves the softness, bulk, and absorbency of web compared to the NTT process. The NTT process flattens the web inside the pocket of the fabric since all the force is being applied by the shoe press to push the web into a fabric pocket that is impermeable or of extremely low permeability to build up hydraulic force to remove the water. The inventive press section uses a press to push the web into a permeable fabric pocket while also drawing the sheet into the fabric pocket using vacuum. This reduces the necessary loading force needed by the shoe press and reduces the buildup of hydraulic pressure, both of which would compress the sheet. The result is that the web within the fabric pocket remains thicker and less compressed, giving the web increased bulk, increased void volume and absorbency, and increased bulk softness. The press section still retains the simplicity, high speed operation, and low energy cost platform of the NTT, but improves the quality of the product.

Figure 4:
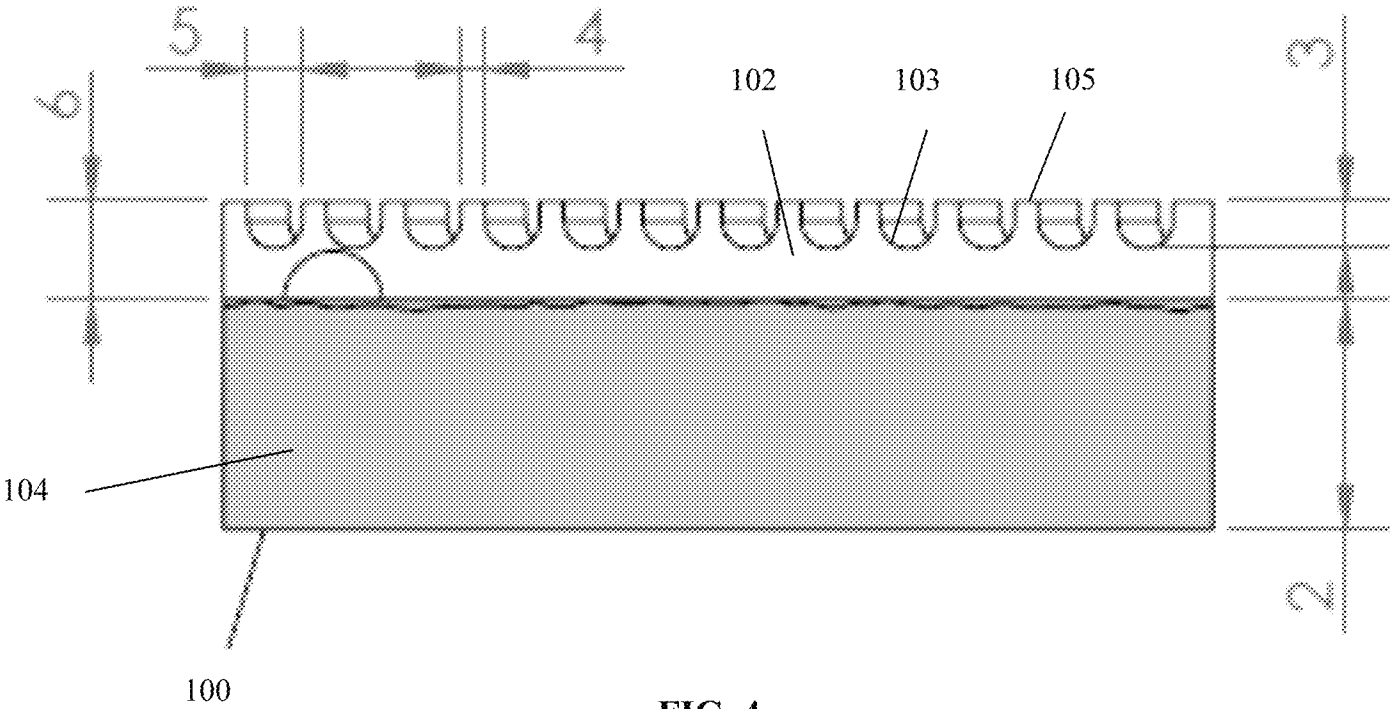
FIG. 4 is a cross-sectional view of a fabric or belt according to an exemplary embodiment of the present invention.
Figure 5:
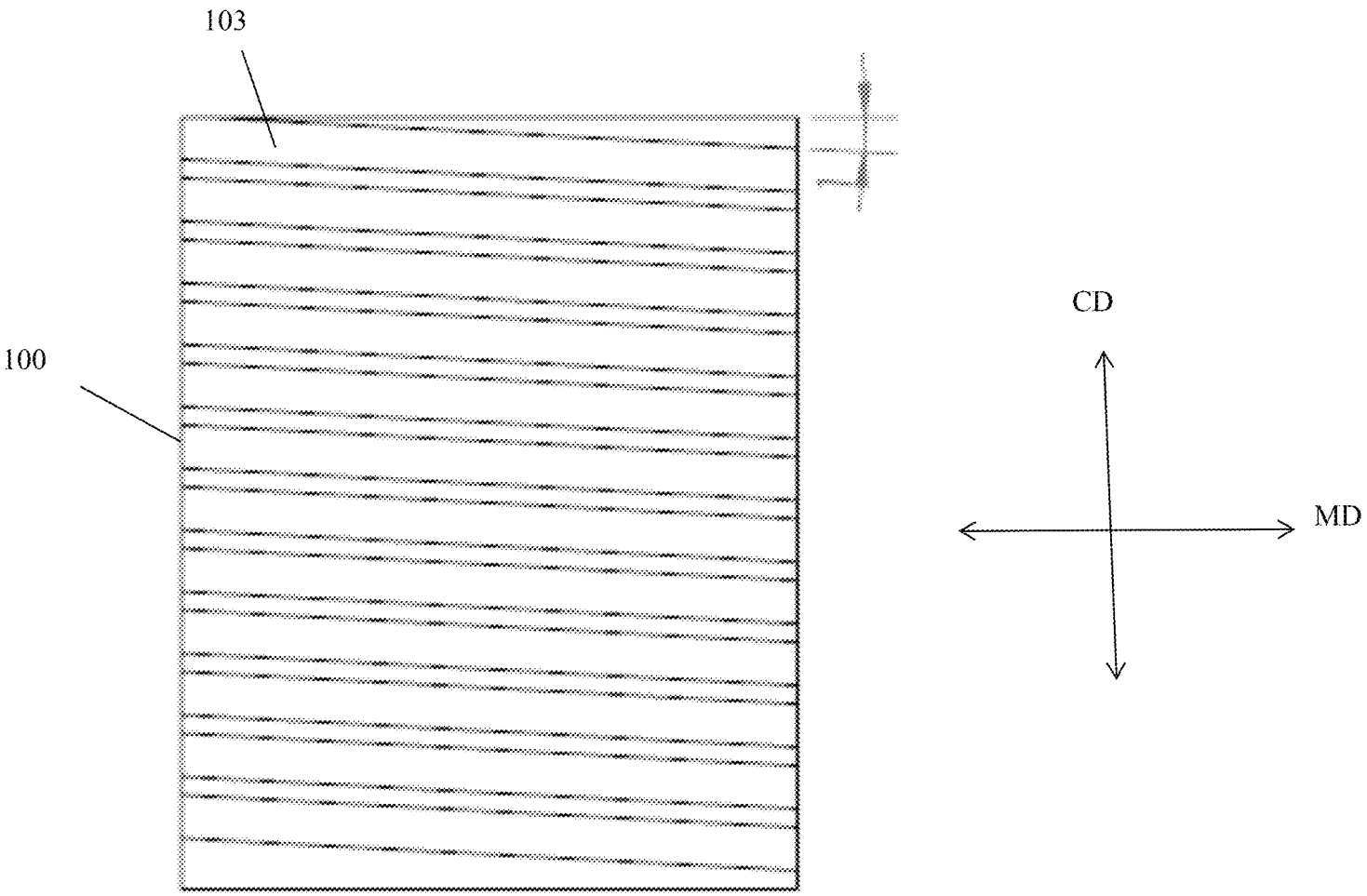
FIG. 5 is a planar view of the fabric of belt of FIG. 4.
Figure 13:
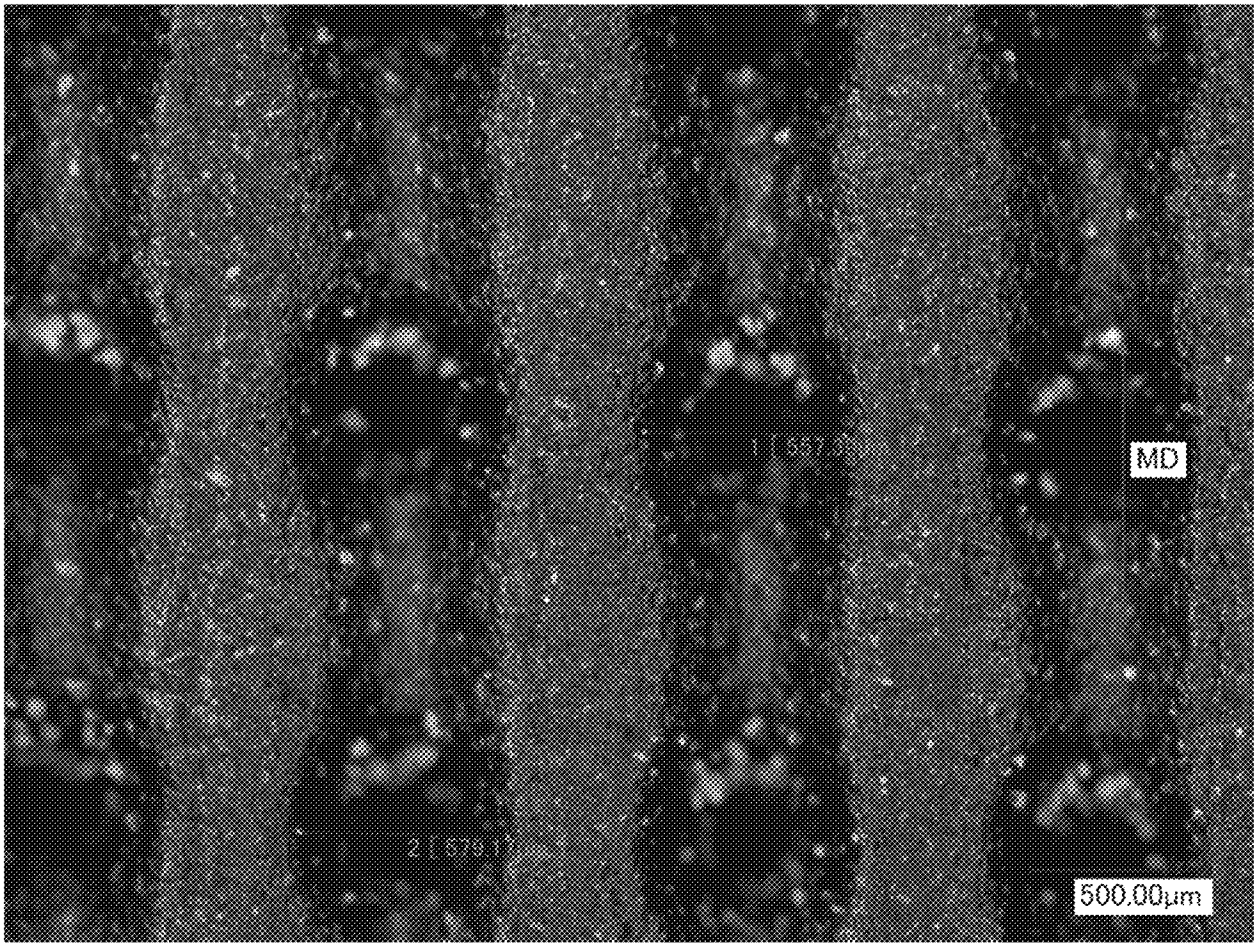
FIG. 13 is an image of a belt or fabric according to an exemplary embodiment of the present invention.
Figure 14:
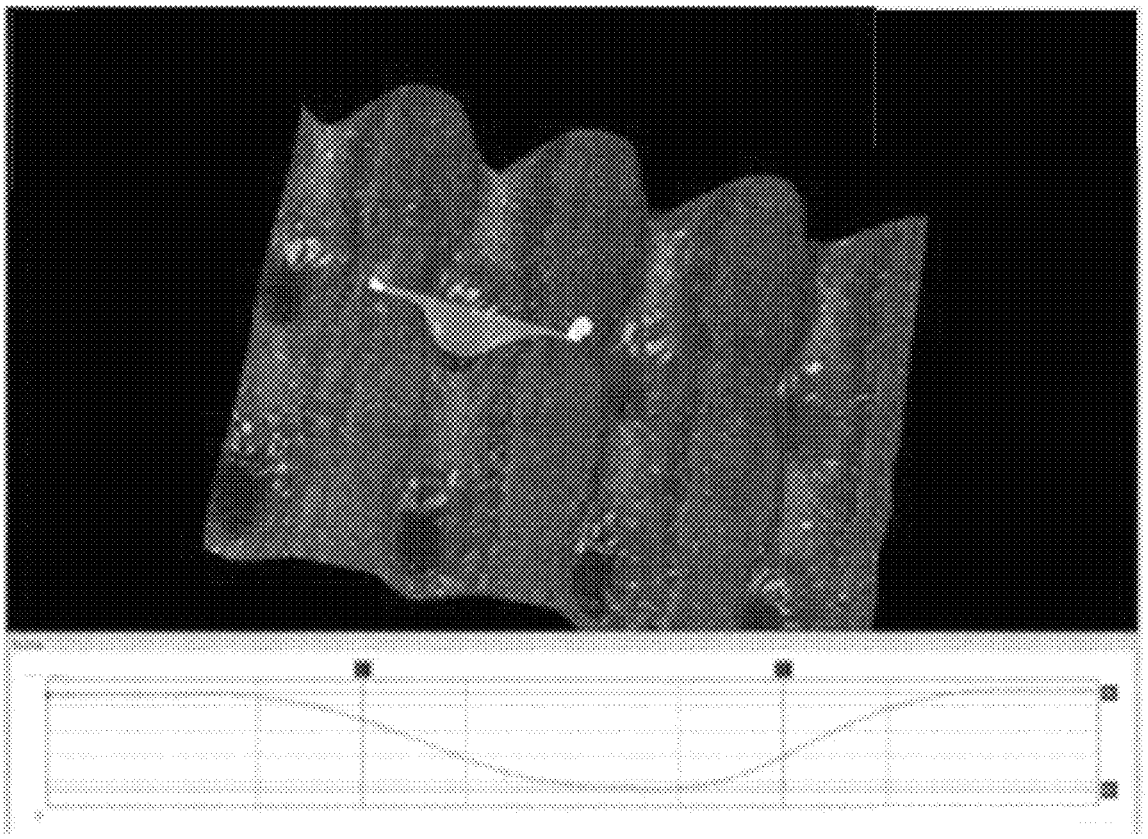
FIG. 14 is an image of a belt or fabric according to an exemplary embodiment of the present invention.

FIG. 4 is a cross-sectional view and FIG. 5 is a top planar view of a structuring belt or fabric, generally designated by reference number 100, according to another exemplary embodiment of the present invention. The belt or fabric 100 is multilayered and includes a layer 102 that forms the side of the belt or fabric carrying the paper web, and a woven fabric layer 104 forming the non-paper web contacting side of the belt or fabric. The layer 102 is made of a polymeric material and, in an exemplary embodiment, the layer 102 is made of a sheet of extruded polymeric material. Grooves 103 and corresponding ridges 105 between the grooves 103 are formed in the layer 102 by laser drilling and the grooves extend at an angle (1) relative to the machine direction, and in embodiments the grooves 103 are angled 0.1 degrees to 45 degrees relative to the machine direction, preferably 0.1 degrees to 5 degrees relative to the machine direction, and more preferably 2 degrees to 3 degrees relative to the machine direction. In a preferred exemplary embodiment, the grooves are angled 2 degrees relative to the machine direction. The grooves 103 have a depth (3) that varies (that is, the depth of each groove along its length varies) within the range of 250 microns to 800 microns, preferably 400 microns to 750 microns, and more preferably 400 microns to 600 microns. The variation in groove depth minimizes or prevents collapse of the grooves 103 (i.e., collapse of the surfaces defining the grooves 103) while the belt or fabric 100 is in the main press nip of the paper making machine. FIGS. 13 and 14 are images of an exemplary embodiment of the belt or fabric 100 showing the varying depth of the grooves. The ridges 105 are thinnest in width at locations along the length of the belt of fabric 100 where the grooves 103 are the deepest, so that at those locations the grooves 105 are closest together. The width (5) of the grooves 103 are within the range of 450 microns to 600 microns. The grooves 103 have a square, semicircular or tapered profile, and the distance (4) between each groove 103 is within the range of 100 microns to 1.5 mm, preferably 200 microns to 500 microns, and more preferably 200 microns to 300 microns. The layer 102 has a thickness (6) of 250 microns to 1.5 mm, preferably 500 microns to 1.0 mm, and more preferably 750 microns to 1.0 mm. In a preferred exemplary embodiment, the layer 102 has a thickness (6) of 1.4 mm and the woven fabric layer 104 has a thickness of 2.4 mm. In an exemplary embodiment, the fabric or belt 100 is subjected to punching, drilling or laser drilling to achieve an air permeability of 20 cfm to 200 cfm, preferably 20 cfm to 100 cfm, and more preferably 10 cfm to 50 cfm.

In a variation of the exemplary embodiment shown in FIG. 4, additional grooves are formed in the layer 102 which extend in the cross direction. Portions of the layer 102 between the cross direction grooves are lower than portions between the machine direction grooves, so that the portions between the machine direction grooves form elevated elements in the surface of the layer 102 in contact with the web, similar to the embodiment shown in FIG. 1.

According to an exemplary embodiment of the present invention, a tissue product is formed using the laser engraved structuring belt described with reference to FIGS. 4 and 5 within an NTT paper making machine, such as the NTT paper making machine described in PCT Patent Application Publication No. WO 2009/067079, the contents of which are incorporated herein by reference in their entirety. The resulting tissue exhibits a unique Sdr value as defined in ISO 25178-2 (2012) which is a parameter that defines the actual surface area of a material as compared to the projected surface area of the material. The formula used to calculate Sdr is as follows:

4.3.2 developed interfacial area ratio of the scale-limited surface $S_{dl}$ ratio of the increment of the interfacial area of the scale-limited surface within the definition area (A) over the definition area $$S_{dr} = \frac{1}{A}\left[\int\int_A \left(\sqrt{\left[1+\left(\frac{\partial z(x,y)}{\partial x}\right)^2+\left(\frac{\partial z(x,y)}{\partial y}\right)^2\right]}-1\right)dxdy\right]$$

Figure 15:
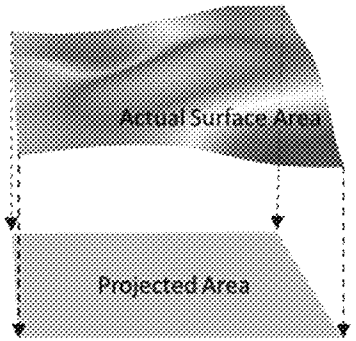
FIG. 15 is a representation of the formula used to calculated Sdr values.

In practical terms the formula can be represented as shown in FIG. 15.

The larger the Sdr parameter, the larger the actual surface area compared to the projected surface area. In terms of comparing tissue paper; assuming both sheets have the same length, width, and thickness, a tissue with a higher Sdr parameter will have a larger surface area, thereby providing enhanced ability to remove contaminants from any surface. Without being bound by theory, a tissue with a higher Sdr should be able to remove and retain a greater amount of contamination from a person's peranial area when using the tissue to clean after a bowel movement to provide improved cleaning compared to a tissue with a lower Sdr value.

The following example and test results demonstrate the advantages of the present invention.

Softness Testing

Softness of a 2-ply tissue web was determined using a Tissue Softness Analyzer (TSA), available from EMTEC Electronic GmbH of Leipzig, Germany. The TSA comprises a rotor with vertical blades which rotate on the test piece applying a defined contact pressure. Contact between the vertical blades and the test piece creates vibrations which are sensed by a vibration sensor. The sensor then transmits a signal to a PC for processing and display. The frequency analysis in the range of approximately 200 to 1000 Hz represents the surface smoothness or texture of the test piece and is referred to as the TS750 value. A further peak in the frequency range between 6 and 7 kHz represents the bulk softness of the test piece and is referred to as the TS7 value. Both TS7 and TS750 values are expressed as dB $V^2$ rms. The stiffness of the sample is also calculated as the device measures deformation of the sample under a defined load. The stiffness value (D) is expressed as mm/N. The device also calculates a Hand Feel (HF) number with the higher the number corresponding to a higher softness as perceived when someone touches a tissue sample by hand. The HF number is a combination of the TS750, TS7, and stiffness of the sample measured by the TSA and calculated using an algorithm which also requires the caliper and basis weight of the sample. Different algorithms can be selected for different facial, toilet, and towel paper products. Before testing, a calibration check should be performed using "TSA Leaflet Collection No. 9" available from EMTECH dated 2016 May 10. If the calibration check demonstrates a calibration is necessary, follow "TSA Leaflet Collection No. 10" for the calibration procedure available from EMTECH dated 2015 Sep. 9.

A punch was used to cut out five 100 $cm^2$ round samples from the web. One of the samples was loaded into the TSA, clamped into place (outward facing or embossed ply facing upward), and the TPII algorithm was selected from the list of available softness testing algorithms displayed by the TSA. After inputting parameters for the sample (including caliper and basis weight), the TSA measurement program was run. The test process was repeated for the remaining samples and the results for all the samples were averaged and the average HF number recorded.

Stretch & MD, CD, and Wet CD Tensile Strength Testing

An Instron 3343 tensile tester, manufactured by Instron of Norwood, Mass., with a 100N load cell and 25.4 mm rubber coated jaw faces was used for tensile strength measurement. Prior to measurement, the Instron 3343 tensile tester was calibrated. After calibration, 8 strips of 2-ply product, each one inch by four inches, were provided as samples for each test. The strips were cut in the MD direction when testing MD and in the CD direction when testing CD. One of the sample strips was placed in between the upper jaw faces and clamp, and then between the lower jaw faces and clamp with a gap of 2 inches between the clamps. A test was run on the sample strip to obtain tensile and stretch. The test procedure was repeated until all the samples were tested. The values obtained for the eight sample strips were averaged to determine the tensile strength of the tissue.

Basis Weight

Using a dye and press, six 76.2 mm by 76.2 mm square samples were cut from a 2-ply product being careful to avoid any web perforations. The samples were placed in an oven at 105 deg C. for 5 minutes before being weighed on an analytical balance to the fourth decimal point. The weight of the sample in grams was divided by $(0.0762\ m)^2$ to determine the basis weight in grams/$m^2$.

Caliper Testing

A Thwing-Albert ProGage 100 Thickness Tester, manufactured by Thwing Albert of West Berlin, N.J., with a 2" diameter pressure foot with a preset loading of 93.0 grams/square inch, was used for the caliper test. Eight 100 mm×100 mm square samples were cut from a 2-ply product. The samples were then tested individually and the results were averaged to obtain a caliper result for the base sheet.

Lint Testing

The amount of lint generated from a tissue product was determined with a Sutherland Rub Tester. This tester uses a motor to rub a weighted felt 5 times over the stationary tissue. The Hunter Color L value is measured before and after the rub test. The difference between these two Hunter Color L values is calculated as lint.

Lint Testing—Sample Preparation:

Prior to the lint rub testing, the paper samples to be tested should be conditioned according to Tappi Method #T4020M-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C. This rub testing should also take place within the confines of the constant temperature and humidity room.

The Sutherland Rub Tester may be obtained from Testing Machines, Inc. (Amityville, N.Y. 11701). The tissue is first prepared by removing and discarding any product which might have been abraded in handling, e.g. on the outside of the roll. For multi-ply finished product, three sections with each containing two sheets of multi-ply product are removed and set on the bench-top. For single-ply product, six sections with each containing two sheets of single-ply product are removed and set on the bench-top. Each sample is then folded in half such that the crease is running along the cross direction (CD) of the tissue sample. For the multi-ply product, make sure one of the sides facing out is the same side facing out after the sample is folded. In other words, do not tear the plies apart from one another and rub test the sides facing one another on the inside of the product. For the single-ply product, make up 3 samples with the off-Yankee side out and 3 with the Yankee side out. Keep track of which samples are Yankee side out and which are off-Yankee side out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5"×6". Puncture two holes into each of the six cards by forcing the cardboard onto the hold down pins of the Sutherland Rub tester.

If working with single-ply finished product, center and carefully place each of the 2.5"×6" cardboard pieces on top of the six previously folded samples. Make sure the 6" dimension of the cardboard is running parallel to the machine direction (MD) of each of the tissue samples. If working with multi-ply finished product, only three pieces of the 2.5"×6" cardboard will be required. Center and carefully place each of the cardboard pieces on top of the three previously folded samples. Once again, make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, discard and make up a new sample with a new tissue sample strip.

If working with multi-ply converted product, there will now be 3 samples on the cardboard. For single-ply finished product, there will now be 3 off-Yankee side out samples on cardboard and 3 Yankee side out samples on cardboard.

Lint Testing—Felt Preparation

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25"×8.5"×0.0625. Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snuggly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. For the case of 1-ply tissue product, discard any product which might have been damaged or abraded. Next, obtain 48 strips of tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "Y." Mark the next highest number with the letter "0." Continue marking the samples in this alternating "Y"/"O" pattern. Use the "Y" samples for Yankee side out lint analyses and the "0" samples for off-Yankee side lint analyses. For 1-ply product, there are now a total of 24 samples for the new lot of felt and the old lot of felt. Of this 24, twelve are for Yankee side out lint analysis and 12 are for off-Yankee side lint analysis.

Rub and measure the Hunter Color L values for all 24 samples of the old felt as described below. Record the 12 Yankee side Hunter Color L values for the old felt. Average the 12 values. Record the 12 off-Yankee side Hunter Color L values for the old felt. Average the 12 values. Subtract the average initial un-rubbed Hunter Color L felt reading from the average Hunter Color L reading for the Yankee side rubbed samples. This is the delta average difference for the Yankee side samples. Subtract the average initial un-rubbed Hunter Color L felt reading from the average Hunter Color L reading for the off-Yankee side rubbed samples. This is the delta average difference for the off-Yankee side samples. Calculate the sum of the delta average difference for the Yankee-side and the delta average difference for the off-Yankee side and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 Yankee side Hunter Color L values for the new felt. Average the 12 values. Record the 12 off-Yankee side Hunter Color L values for the new felt. Average the 12 values. Subtract the average initial un-rubbed Hunter Color L felt reading from the average Hunter Color L reading for the Yankee side rubbed samples. This is the delta average difference for the Yankee side samples. Subtract the average initial un-rubbed Hunter Color L felt reading from the average Hunter Color L reading for the off-Yankee side rubbed samples. This is the delta average difference for the off-Yankee side samples. Calculate the sum of the delta average difference for the Yankee-side and the delta average difference for the off-Yankee side and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

The same type procedure is applied to two-ply tissue product with 24 samples run for the old felt and 24 run for the new felt. But, only the consumer used outside layers of the plies are rub tested. As noted above, make sure the samples are prepared such that a representative sample is obtained for the old and new felts.

Lint Testing—Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

Lint Testing—Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the starting and stopping point of the felt covered weight. Recalibrate when necessary.

Lint Testing—Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

Lint Testing—Measurement of Samples

The first step in the measurement of lint is to measure the Hunter color values of the black felt/cardboard samples prior to being rubbed on the tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felts strips are not used again. Cardboards are used until they are bent, torn, limp, or no longer have a smooth surface.

Lint Testing—Calculations

Determine the delta L values by subtracting the average initial L reading found for the unused felts from each of the measured values for the off-Yankee and Yankee sides of the sample. Recall, multi-ply-ply product will only rub one side of the paper. Thus, three delta L values will be obtained for the multi-ply product. Average the three delta L values and subtract the felt factor from this final average. This final result is termed the lint for the fabric side of the 2-ply product.

For the single-ply product where both Yankee side and off-Yankee side measurements are obtained, subtract the average initial L reading found for the unused felts from each of the three Yankee side L readings and each of the three off-Yankee side L readings. Calculate the average delta for the three Yankee side values. Calculate the average delta for the three fabric side values. Subtract the felt factor from each of these averages. The final results are termed a lint for the fabric side and a lint for the Yankee side of the single-ply product. By taking the average of these two values, an ultimate lint value is obtained for the entire single-ply product.

Crumple Testing

Crumple of a 2-ply tissue web was determined using a Tissue Softness Analyzer (TSA), available from EMTECH Electronic GmbH of Leipzig, Germany, using the crumple fixture (33 mm) and base. A punch was used to cut out five 100 $cm^2$ round samples from the web. One of the samples was loaded into the crumple base, clamped into place, and the crumple algorithm was selected from the list of available testing algorithms displayed by the TSA. After inputting parameters for the sample, the crumple measurement program was run. The test process was repeated for the remaining samples and the results for all the samples were averaged. Crumple force is a good measure of the flexibility or drape of the product.

Method for Determining Actual Surface Area as Compared to Projected Surface Area.

Acquisition of images used to calculate the Sdr parameter were acquired using a Keyence Model VR-3200 G2 3D Macroscope equipped with motorized XY stage, VR-3000K controller, VR-H2VE version 2.2.0.89 Viewer software, VR-H2AE Analyzer software, and VR-H2J Stitching software. After following calibration procedures, as outlined by Keyence equipment manual, 2 to 3 sheets of bath tissue were torn from a roll and held in place using weights with the desired surface to be measured facing up (towards the macroscope lens). In this case the outward facing ply (the visible surface of the sheet on the roll of tissue paper) was the surface of interest. When tearing the sheets from the roll, the sheets were gently pulled as the perforation so avoid alteration of the topographic features. The machine direction (MD) of the sample was placed in the Y axis (front to back on the stage as seen from operator perspective in front of the system) while the cross direction (CD) was placed in the X axis (left to right on the stage as seen from operator perspective in front of the system). Care was taken to ensure no creases or folds were present in the sample and the sample was not under any MD or CD directional stress. 38× magnification was utilized with the following selections on the viewer software: "one shot 3D" viewer capture method, "normal" capture image type, "standard" height measurement mode, "both sides" measurement direction, "height" image type, "one" skip rate, and stitching turned "off". Prior to measurement, the system was autofocused (double-click autofocus) and then measurement was able to commence by double-clicking "measure". The measured dimensions of approximately 6 mm in the machine direction and approximately 8 mm in the cross direction, avoiding any embossments, was analyzed to attain a topographic profile of the sample. The instrument measured along the cross direction 1024 times then indexed in the machine direction and measured another 1024 times along the cross direction. The instrument indexed 768 times in the machine direction before completing the acquisition. This resulted in a pixel size of 7.887 micrometers both in the X and Y directions. The measurement was repeated 10 times on tissue sheets from the same product before testing a new tissue product. To export the 3-dimensional data as a CSV-Height file format, the 3D image was selected in the analyzer software. "File," "Export," "Output CSV file" were selected. In the window that appeared, "Main image of selected data" was selected. Under Image type, "Height" was selected and under the option Skip, "No skip" was selected. The CSV file was saved in the preferred folder. The collected raw surface profile data (CSV file) was then transferred to a computer running OmniSurf3D analysis software (v1.00.040), available from Digital Metrology Solutions, Inc. of Columbus, Ind., USA for parameter calculation.

The OmniSurf 3D filtering settings were set as follows for preprocessing: Edge Discarding-Use all data, Outlier Removal-None, Missing Data Filling-Linear Fill. The measured data was leveled based on least squares plane. Given the size of the surface features of interest, a wavelength band of 0.25-0.80 mm was selected with the following filtering setting:

Short Wavelength Limitation: Gaussian/0.25 mm/Synch X&Y

Long Wavelenth Limitation: Gaussian/0.8 mm/Sync X&Y

Post-Filter Edge Discarding: None

For the parameter of interest, Sdr was selected. The Sdr parameter was calculated for all areal filtered surface profiles and the results were averaged to obtain an "Sdr" value for the 10 images of each tissue product.

Example 1

A 2-ply creped tissue web was produced on an NTT paper machine with a triple layer headbox, and the web had the following product attributes: Roll Diameter 122 mm, Sheet Count 170, Sheet Width 4 inches, Sheet Length 4 inches, Basis Weight 39.51 g/m$^2$, Caliper 0.426 mm, MD tensile of 144.5 N/m, CD tensile of 51.1 N/m, MD stretch of 24.08%, CD stretch of 7.23%, 93.4 HF, TS7 value of 8.79, lint value of 4.27, Crumple value of 27.13, and an Sdr value of 3.2.

Each of the three layers of the stock system which feed the headbox were prepared using the same furnish ratio of 80% *Eucalyptus,* 20% NBSK. The NBSK was refined at 16 kwh/ton before blending in each layer. The first exterior layer, which was intended to be the layer that contacts the Yankee dryer and that faces outward when laminated into a 2 ply product, was prepared using 1.25 kg/ton of a synthetic polymer dry strength agent DPD-589 (Solenis, 500 Hercules Road, Wilmington Del., 19808) (for strength when wet and lint control). The interior layer was prepared using 1.0 kg/ton of T526, a softener/debonder (EKA Chemicals Inc., 1775 West Oak Commons Court, Marietta, Ga., 30062). The second exterior layer was prepared using 3.75 kg/ton of DPD-589.

The fiber and chemicals mixtures were diluted to a solids of 0.5% consistency and fed to separate fan pumps which delivered the slurry to a triple layered headbox. The headbox pH was controlled to 7.0 by addition of sodium bicarbonate to the thick stock before the fan pumps. The headbox deposited the slurry to a nip formed by a forming roll, an outer forming wire, and a press felt running at 1000 m/min. The slurry was drained through the outer wire, which is a KT194-P design supplied by Asten Johnson (4399 Corporate Rd, Charleston, S.C. (843) 747-7800)), to aid with drainage, fiber support, and web formation. When the fabrics separated, the web followed the press fabric over a suction roll supplying 60 kpa vacuum with steam applied to the sheet using a steambox at 40 kpa pressure before entering a main press, which was a long nip press, which supplied 400 kN/m nip load against a structuring fabric. The structuring fabric was multilayered and included a paper-web contacting layer that formed the side of the belt carrying the paper web. This layer was made of a sheet of extruded polymeric material with a thickness of 1.42 mm. A woven fabric layer having a thickness of 2.54 mm formed the non-paper web contacting side of the belt. Grooves were formed in the paper-web contacting layer by laser drilling. The grooves extended at an angle of 2 degrees relative to the machine direction. The grooves had a varying depth between 300 to 750 microns. The grooves were spaced 350 to 500 microns apart. The grooves were closest to each other at the deepest portions of the grooves where the laser produced a wider portion of the groove compared to the shallower portions of the groove. The width of the grooves were between 450 to 600 microns.

After passing through the main press the web followed the structuring fabric and was then transferred to the Yankee dryer where the web was held in intimate contact with the Yankee surface using an adhesive coating chemistry. The Yankee was provided steam at 600 kpa while the installed hot air impingement hood over the Yankee was blowing heated air at 450 deg C. The web was creped from the Yankee at 20% crepe at 98.2% dryness using a steel blade at a pocket angle of 90 degrees.

In the Converting process, the two webs were plied together using light embossing of the DEKO configuration (only the top sheet was embossed with glue applied to the inside of the top sheet at the high points derived from the embossments using an adhesive supplied by a cliché roll) with the second exterior layer of each web facing each other. The % coverage of the embossment on the top sheet was 4%. The product was wound into a 170 count product at 121 mm roll diameter.

Comparative Example 1

A 2-ply creped tissue web was produced on an NTT paper machine with a triple layer headbox, and the web had the following product attributes: Roll Diameter 122 mm, Sheet Count 170, Sheet Width 4 inches, Sheet Length 4 inches, Basis Weight 39.93 g/m$^2$, Caliper 0.436 mm, MD tensile of 118.14 N/m, CD tensile of 64.86 N/m, MD stretch of 18.29%, CD stretch of 4.79%, 87.8 HF, TS7 value of 9.85, lint value of 3.74, Crumple value of 35.29, and Sdr value of 2.3.

Each of the three layers of the stock system which feed the headbox were prepared using the same furnish ratio of 80% *Eucalyptus,* 20% NBSK. The NBSK was refined at 16 kwh/ton before blending in each layer. The first exterior layer, which was intended to be the layer that contacts the Yankee dryer and that faces outward when laminated into a 2 ply product, was prepared using 1.25 kg/ton of a synthetic polymer dry strength agent DPD-589. The interior layer was prepared using 1.0 kg/ton of T526, a softener/debonder. The second exterior layer was prepared using 3.75 kg/ton of DPD-589.

The fiber and chemical mixtures were diluted to a solids of 0.5% consistency and fed to separate fan pumps which delivered the slurry to a triple layered headbox. The headbox pH was controlled to 7.0 by addition of sodium bicarbonate to the thick stock before the fan pumps. The headbox deposited the slurry to a nip formed by a forming roll, an outer forming wire, and a press felt running at 1000 m/min. The slurry was drained through the outer wire, which was a KT194-P design supplied by Asten Johnson (4399 Corporate Rd, Charleston, S.C. (843) 747-7800)), to aid with drainage, fiber support, and web formation. When the fabrics separated, the web followed the press fabric over a suction roll supplying 60 kpa vacuum with steam applied to the sheet using a steambox at 40 kpa pressure before entering a main press, which was a long nip press, supplying 600 kN/m nip load against a commercially available structuring fabric (typically referred to as the medium belt from Albany International, 216 Airport Drive Rochester, N.H. 03867 USA, 1-603-330-5850) made from extruded polymer with laser engraved holes laminated to a support layer composed of woven monofilaments or multi-filamentous yarns needled with fine synthetic batt fibers.

After passing through the main press the web followed the structuring fabric and was then transferred to the Yankee dryer where the web was held in intimate contact with the Yankee surface using an adhesive coating chemistry. The Yankee was provided steam at 600 kpa while the installed hot air impingement hood over the Yankee was blowing heated air at 450 deg C. The web was creped from the Yankee at 20% crepe at 98.2% dryness using a steel blade at a pocket angle of 90 degrees.

In the Converting process, the two webs were plied together using light embossing of the DEKO configuration (only the top sheet was embossed with glue applied to the inside of the top sheet at the high points derived from the embossments using and adhesive supplied by a cliché roll) with the second exterior layer of each web facing each other. The % coverage of the embossment on the top sheet was 4%. The product was wound into a 170 count product at 121 mm roll diameter.

Comparative Example 2

A 2-ply creped tissue web was produced on an NTT paper machine with a triple layer headbox, and the web had the following product attributes: Roll Diameter 122 mm, Sheet Count 170, Sheet Width 4 inches, Sheet Length 4 inches, Basis Weight 40.2 g/m$^2$, Caliper 490.57 mm, MD tensile of 95.05 N/m, CD tensile of 44.14 N/m, an MD stretch of 18.32%, a CD stretch of 5.81%, 91.86 HF, TS7 value of 9.70, a lint value of 5.2, a Crumple value of 27.74, and an Sdr value of 2.06.

Each of the three layers of the stock system which feed the headbox were prepared using the same furnish ratio of 80% *Eucalyptus,* 20% NB SK. The NBSK was unrefined. The first exterior layer, which was intended to be the layer that contacts the Yankee dryer and faces outward when laminated into a 2 ply product, was prepared using 3.0 kg/ton of a synthetic polymer dry strength agent DPD-589. The interior layer was prepared using 1.0 kg/ton of T526. The second exterior layer was prepared using 3.0 kg/ton of DPD-589.

The fiber and chemical mixtures were diluted to a solids of 0.5% consistency and fed to separate fan pumps which delivered the slurry to a triple layered headbox. The headbox pH was controlled to 7.0 by addition of sodium bicarbonate to the thick stock before the fan pumps. The headbox deposited the slurry to a nip formed by a forming roll, an outer forming wire, and a press felt running at 1200 m/min. The slurry was drained through the outer wire, which is a KT194-P design supplied by Asten Johnson. When the fabrics separated, the web followed the press fabric over a suction roll supplying 60 kpa vacuum with steam applied to the sheet using a steambox at 40 kpa pressure before entering a main press, which was a long nip press, supplying 400 kN/m nip load against a commercially available structuring fabric (typically referred to as the coarse belt from Albany International) made from extruded polymer with laser engraved holes laminated to a support layer composed of woven monofilaments or multi-filamentous yarns needled with fine synthetic batt fibers.

After passing through the main press the web followed the structuring fabric and was then transferred to the Yankee dryer where the web was held in intimate contact with the Yankee surface using an adhesive coating chemistry. The Yankee was provided steam at 600 kpa while the installed hot air impingement hood over the Yankee was blowing heated air at 450 deg C. The web was creped from the Yankee at 20% crepe at 98.0% dryness using a steel blade at a pocket angle of 90 degrees.

In the Converting process, the two webs were plied together using light embossing of the DEKO configuration (only the top sheet was embossed with glue applied to the inside of the top sheet at the high points derived from the embossments using an adhesive supplied by a cliché roll) with the second exterior layer of each web facing each other. The % coverage of the embossment on the top sheet was 4%. The product was wound into a 170 count product at 121 mm roll diameter.

Comparative Test Results from Commercially Available Products

FIGS. 17A and 17B show various attributes of commercially available products as compared to those of Example 1.

The test results shown in FIGS. 17A and 17B confirm that the present invention is advantageous as all the other products do not demonstrate the same levels of high softness and low lint.

Figure 16:
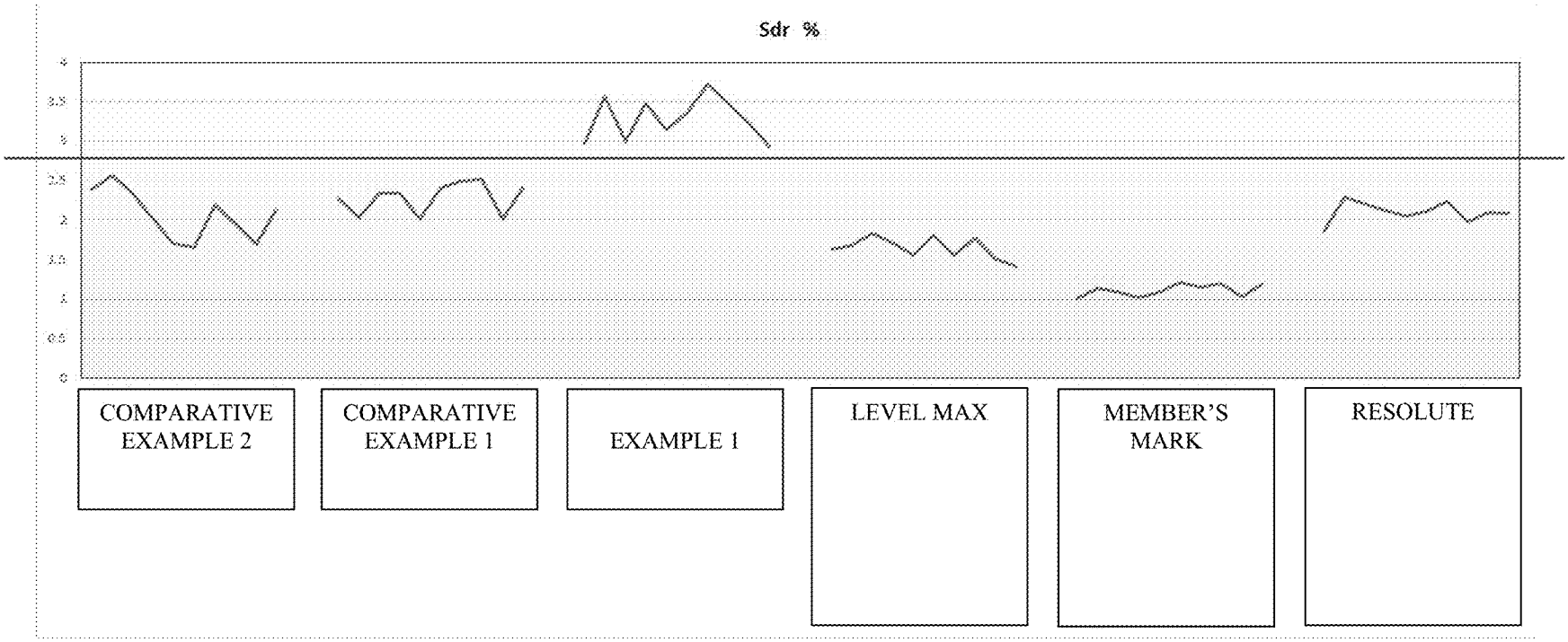
FIG. 16 shows Sdr values for ten samples each of six different NTT tissue products, including Comparative Examples 1 and 2, Example 1, and three commercially available NTT tissue products.

Also, as shown in FIG. 16, the tissue products made in accordance with the present invention exhibit improved Sdr values as compared to conventional tissue products. Specifically, FIG. 16 shows Sdr values for ten samples each of six different NTT tissue products, including Comparative Examples 1 and 2, Example 1, and three commercially available NTT tissue products. The three commercially available products include Resolute, which is produced on a standard "fine" NTT fabric from Albany International, and Level Max and Member's Mark, which were produced on an NTT machine in Mexicali, Mexico. All the products were two ply tissue. As shown, only Example 1 had an Sdr value greater than 2.75.

Example 2

A 2-ply creped tissue web was produced on a Through Air Dried paper machine with a triple layer headbox and dual TAD drums. The tissue web had the following product attributes: Basis Weight 39.87 g/m2, Caliper 0.586 mm, MD tensile of 126.32 N/m, CD tensile of 75.25 N/m, MD stretch of 13.19%, CD stretch 8.62%, 84 HF, lint value of 1.83, Ball Burst of 318 gf, Geometric Mean Tensile of 97.44 N/m, Geometric Mean Stretch of 10.66%, a value of 3.27 when Ball Burst is divided by Geometric Mean Tensile, and a value of 0.31 when Ball Burst is divided by the product of Geometric Mean Tensile and Geometric Mean Stretch.

The tissue web was multilayered, with the first exterior layer (the layer intended for contact with the Yankee dryer) prepared using 75% *Eucalyptus* Bleached Kraft and 25% Northern Softwood Bleached Kraft pulp with 1.25 kg/ton of Hercobond 1194 temporary wet strength and 0.25 kg/ton of Hercobond 6950 from Solenis (500 Hercules Road, Wilmington Del., 19808) as well as 0.875 kg/ton of Redibond 2038 amphoteric starch from Corn Products (10 Finderne Avenue, Bridgewater, N.J. 08807). The interior layer was composed of 75% *Eucalyptus* Bleached Kraft and 25% Northern Softwood Bleached Kraft pulp, with 1.09 kg/ton T526 and 1.25 kg/ton of Hercobond 1194. The second exterior layer was composed of 100% Northern Softwood Bleached Kraft pulp, 2.625 kg/ton of Redibond 2038 and 0.25 kg/ton of Hercobond 6950. The softwood was refined at 13 kwh/ton.

The fiber and chemical mixtures were diluted to a solids of 0.5% consistency and fed to separate fan pumps which delivered the slurry to a triple layered headbox. The headbox pH was controlled to 7.0 by addition of sodium bicarbonate to the thick stock before the fan pumps. The headbox deposited the slurry to a nip formed by a forming roll, an outer forming wire, and inner forming wire where the wires were running at a speed of 1060 m/min. The slurry was drained through the outer wire, which was a KT194-P design. When the fabrics separated, the web followed the inner forming wire and was dried to approximately 27% solids using a series of vacuum boxes and a steam box.

The web was then transferred to a structured fabric running at 1060 m/min with the aid of a vacuum box to facilitate fiber penetration into the structured fabric to enhance bulk softness and web imprinting. The structured fabric was comprised of an extruded polymer or copolymer netting with a thickness of 0.7 mm, with openings being regularly recurrent and distributed in the longitudinal (MD) and cross direction (CD) of the layer. The openings were approximately circular with a diameter of 0.75 mm. The MD aligned portions of the netting of the structuring layer extended 0.23 mm above the top plane of the CD aligned portions of the netting of the structuring layer. The width of the MD aligned portion of the netting of the structuring layer was 0.52 mm. The width of the CD aligned portion of the netting of the structuring layer was 0.63 mm and the length was 0.75 mm. The support layer was a Prolux N005, 5 shed 1, 3, 5, 2, 4 warp pick sequence woven polymer fabric sanded to 27% contact area, supplied by Albany with a caliper of 0.775 mm. The two layers were laminated together using ultrasonic welding.

The web was dried with the aid of two TAD hot air impingement drums to 81% moisture before transfer to the Yankee dryer. The web was held in intimate contact with the Yankee surface using an adhesive coating chemistry. The Yankee was provided steam at 300 kpa while the installed hot air impingement hood over the Yankee was blowing heated air at 125 deg C. The web was creped from the Yankee at 13.2% crepe at 98.2% dryness using a steel blade at a pocket angle of 90 degrees.

In the Converting process, the two webs were plied together using light embossing of the DEKO configuration (only the top sheet was embossed with glue applied to the inside of the top sheet at the high points derived from the embossments using an adhesive supplied by a cliché roll) with the second exterior layer of each web facing each other. The % coverage of the embossment on the top sheet was 4%. The product was wound into a 235 count product at 127 mm roll diameter with a sheet length of 101.5 mm (perforation to perforation) and a sheet width of 108.5 mm (top of roll to bottom of roll).

Comparative Example 3

A 2-ply creped tissue web was produced on a Through Air Dried paper machine with a triple layer headbox and dual TAD drums. The tissue product had the following product attributes: Basis Weight 39.60 g/m$^2$, Caliper 0.567 mm, MD tensile of 128.91 N/m, CD tensile of 70.32 N/m, MD stretch of 15.90%, CD stretch of 7.43%, 88 HF, lint value of 4.37, Ball Burst of 269 gf, Geometric Mean Tensile of 95.14 N/m, Geometric Mean Stretch of 10.87%, a value of 2.93 when Ball Burst is divided by Geometric Mean Tensile, and a value of 0.26 when Ball Burst is divided by the product of Geometric Mean Tensile and Geometric Mean Stretch.

The tissue web was multilayered, with the first exterior layer, which was the layer intended for contact with the Yankee dryer, prepared using 75% *Eucalyptus* Bleached Kraft and 25% Northern Softwood Bleached Kraft pulp with 1.25 kg/ton of Hercobond 1194 temporary wet strength and 0.25 kg/ton of Hercobond 6950 from Solenis as well as 1.0 kg/ton of Redibond 2038 amphoteric starch from Corn Products. The interior layer was composed of 75% *Eucalyptus* Bleached Kraft and 25% Northern Softwood Bleached Kraft pulp, with 0.75 kg/ton T526 and 1.25 kg/ton of Hercobond 1194. The second exterior layer was composed of 100% Northern Softwood Bleached Kraft pulp, 3.0 kg/ton of Redibond 2038 and 0.25 kg/ton of Hercobond 6950. The softwood was refined at 17 kwh/ton.

The fiber and chemical mixtures were diluted to a solids of 0.5% consistency and fed to separate fan pumps which delivered the slurry to a triple layered headbox. The headbox pH was controlled to 7.0 by addition of sodium bicarbonate to the thick stock before the fan pumps. The headbox deposited the slurry to a nip formed by a forming roll, an outer forming wire, and inner forming wire where the wires were running at a speed of 1060 m/min. The slurry was drained through the outer wire, which was a KT194-P design. When the fabrics separated, the web followed the inner forming wire and was dried to approximately 27% solids using a series of vacuum boxes and a steam box.

The web was then transferred to a structured fabric running at 1060 m/min with the aid of a vacuum box to facilitate fiber penetration into the structured fabric to enhance bulk softness and web imprinting. The structured fabric was a Prolux 005, 5 shed 1, 3, 5, 2, 4 warp pick sequence woven polymer fabric sanded to 27% contact area supplied by Albany (216 Airport Drive Rochester, N.H. 03867 USA Tel: +1.603.330.5850) with a caliper of 1.02 mm.

The web was dried with the aid of two TAD hot air impingement drums to 81% moisture before transfer to the Yankee dryer. The web was held in intimate contact with the Yankee surface using an adhesive coating chemistry. The Yankee was provided steam at 300 kpa while the installed hot air impingement hood over the Yankee was blowing heated air at 125 deg C. The web was creped from the Yankee at 13.2% crepe at 98.2% dryness using a steel blade at a pocket angle of 90 degrees.

In the Converting process, the two webs were plied together using light embossing of the DEKO configuration (only the top sheet was embossed with glue applied to the inside of the top sheet at the high points derived from the embossments using an adhesive supplied by a cliché roll) with the second exterior layer of each web facing each other. The % coverage of the embossment on the top sheet was 4%. The product was wound into a 235 count product at 127 mm roll diameter with a sheet length of 101.5 mm (perforation to perforation) and a sheet width of 108.5 mm (top of roll to bottom of roll).

FIGS. 18A-18C provide the relevant data from Example 2 and Comparative Example 3, as well as for certain commercially available products.

As demonstrated above, Example 2, which was produced using the laminated structuring fabric with extruded polymer netting in accordance with an exemplary embodiment of the present invention, had a much higher Ball Burst strength and lower lint at nearly identical tensile strength (as measured by Geometric Mean Tensile) and stretch (as measured by Geometric Mean Stretch) values as compared to Comparative Example 3, which was made using a conventional structured fabric. The conditions used in Example 2 and Comparative Example 3 were nearly identical with the only significant difference being lower refining, lower starch, and higher debonder use in Example 2 in order to decrease tensile strength to target levels.

Without being bound by theory, it is believed that in accordance with the present invention a symmetric, continuous compressed fiber network is imprinted into the web corresponding to the MD and CD aligned ridges of the extruded polymer structuring fabric layer as the web is nipped between the pressure roll and the Yankee dryer. This symmetric continuous compressed fiber network enhances fiber to fiber bonding in these areas of compression. The Ball Burst strength or "puncture resistance" of the web improves due to the continuity of the network and the geometry of the network being aligned in the CD and MD direction. This geometry creates a symmetric network where every intersection of the MD and CD compressions are at approximately 90 degrees allowing for even distribution of force when a force is applied in the perpendicular direction or "Z" direction as occurs during the Ball Burst test. The Ball Burst test is an important physical property of the tissue web as it most closely simulates the type of force the product will undergo when in use, such as when a person applies force in the Z direction upon the tissue web when being used to clean the perianal area.

What is also of interest in the inventive product is that high Ball Burst strength can be achieved with a lower level of tensile strength, as measured by Geometric Mean Tensile. The inventive product also can achieve levels of Ball Burst at low levels of stretch, as measured by Geometric Mean Stretch. This is important because tensile strength and stretch are parameters that are primarily used to control Ball Burst strength, with higher levels increasing Ball Burst strength. In order to increase tensile strength, refining or chemical additives are typically added which increase the cost of the product (energy and chemical costs). Higher refining also slows drainage from the web in the forming section which will then need to be removed in the TAD section, increasing energy costs as higher temperatures will be required to remove the water. Generation of higher levels of stretch are also costly since the primary mechanism of stretch development is to run a speed differential between the forming and imprinting fabric or between the Yankee dryer and reel drum. If running a speed differential between the forming and imprinting fabric, the higher the differential is run, the higher stretch is developed, but also the higher the loss of strength. The same loss of tensile occurs if using a speed differential between the Yankee dryer and reel drum. Productivity can also be effected as both techniques require speed reductions in sections of the paper machine. Thus, it is very advantageous, on a cost and productivity basis, to generate Ball Burst strength by creating a unique compressed fiber network that is symmetric, continuous, and that has the ability to distribute forces uniformly when the force is applied perpendicularly to the product rather than relying on increasing tensile strength or stretch to generate Ball Burst strength.

Two parameters that demonstrate the uniquely high Ball Burst strength of the inventive product compared to the low values of tensile strength and stretch of the product are Ball Burst divided by the Geometric Mean Tensile or Ball Burst divided by the product of Geometric Mean Tensile and Geometric Mean Stretch. The Geometric Mean Tensile is simply the square root of the product of MD and CD tensile while Geometric Mean Stretch is the square root of the product of MD and CD stretch. The inventive product has higher values when looking at both of these parameters compared to conventional tissue products.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

The invention claimed is:

1. A tissue product comprising: a laminate of at least two plies of a multi-layer tissue web, the tissue product having a softness value (HF) of 92.0 or greater, a lint value of 4.5 or less, and an Sdr of greater than 3.0.

2. The tissue product of claim 1, wherein the tissue product has a bulk softness of less than 9 TS7.

3. The tissue product according to claim 1, wherein the multi-layer tissue web comprises: a first exterior layer; an interior layer; and a second exterior layer.

4. The tissue product according to claim 3, wherein the first exterior layer comprises at least 50% virgin hardwood fibers.

5. The tissue product according to claim 3, wherein the first exterior layer comprises at least 75% virgin hardwood fibers.

6. The tissue product according to claim 4, wherein the virgin hardwood fibers is virgin *Eucalyptus* fibers.

7. The tissue product according to claim 3, wherein the interior layer contains a first wet end additive comprising an ionic surfactant and a second wet end additive comprising a non-ionic surfactant.

8. The tissue product according to claim 3, wherein the first exterior layer comprises a wet end dry strength additive.

9. The tissue product according to claim 8, wherein the wet end dry strength additive comprises a graft copolymer composition of a vinyl monomer and a functionalized vinyl amine-containing base polymer.

10. The tissue product according to claim 3, wherein the second exterior layer comprises a wet end dry strength additive.

11. The tissue product according to claim 10, wherein the wet end dry strength additive comprises a graft copolymer composition of a vinyl monomer and a functionalized vinyl amine-containing base polymer.

12. The tissue product according to claim 7, wherein the second wet end additive comprises an ethoxylated vegetable oil.

13. The tissue product according to claim 7, wherein the second wet end additive comprises a combination of ethoxylated vegetable oils.

14. The tissue product according to claim 7, wherein the ionic surfactant comprises a debonder.

15. The tissue product according to claim 3, wherein the first and second exterior layers are substantially free of surface deposited softener agents or lotions.

16. The tissue product according to claim 3, wherein the first exterior layer comprises a surface deposited softener agent or lotion.

17. The tissue product of claim 1, wherein the tissue product has an MD tensile strength and CD tensile strength of at least 50 N/m and a basis weight of less than 40 gsm.

18. The tissue product of claim 1, wherein each of the at least two plies comprises embossed areas, wherein the embossed area occupy between 3% to 15% of the total surface area of a surface of the ply.

19. The tissue product of claim 1, wherein the tissue product is one of sanitary, bath or facial tissue.

20. The tissue product of claim 1, wherein the tissue product has a softness value (HF) of 93.0 or greater, a lint value of 4.3 or less, and an Sdr of greater than 3.0.

* * * * *